US010984646B2

(12) United States Patent
Schwab et al.

(10) Patent No.: US 10,984,646 B2
(45) Date of Patent: Apr. 20, 2021

(54) PROXIMITY BASED FALL AND DISTRESS DETECTION SYSTEMS AND METHODS

(71) Applicant: MAYO FOUNDATION FOR MEDICAL EDUCATION AND RESEARCH, Rochester, MN (US)

(72) Inventors: Daniel J. Schwab, Mantorville, MN (US); Barry K. Gilbert, Rochester, MN (US); Clifton R. Haider, Rochester, MN (US); Mark E. Vickberg, Rochester, MN (US); Gary S. Delp, Rochester, MN (US); Christopher L. Felton, Rochester, MN (US); Patrick J. Zabinski, Stewartville, MN (US)

(73) Assignee: Mayo Foundation for Medical Education and Research, Rochester, MN (US)

( * ) Notice: Subject to any disclaimer, the term of this patent is extended or adjusted under 35 U.S.C. 154(b) by 0 days.

(21) Appl. No.: 16/312,779

(22) PCT Filed: Jun. 22, 2017

(86) PCT No.: PCT/US2017/038794
§ 371 (c)(1),
(2) Date: Dec. 21, 2018

(87) PCT Pub. No.: WO2017/223339
PCT Pub. Date: Dec. 28, 2017

(65) Prior Publication Data

US 2019/0333354 A1 Oct. 31, 2019

Related U.S. Application Data

(60) Provisional application No. 62/354,044, filed on Jun. 23, 2016.

(51) Int. Cl.
*G08B 23/00* (2006.01)
*G08B 21/04* (2006.01)

(52) U.S. Cl.
CPC ..... *G08B 21/0446* (2013.01); *G08B 21/043* (2013.01)

(58) Field of Classification Search
CPC ..... G08B 21/0446; G08B 21/043
(Continued)

(56) References Cited

U.S. PATENT DOCUMENTS 7,567,200 B1 * 7/2009 Osterweil ..... A61B 5/1117 342/28
7,973,645 B1 * 7/2011 Moretti ..... G06K 7/10356 340/10.1
(Continued)

FOREIGN PATENT DOCUMENTS

WO 2009138941 A1 11/2009
WO 2015028283 A1 3/2015

OTHER PUBLICATIONS

European Patent Office, Extended European Search Report and Search Opinion for application 17816222.8, dated Jan. 13, 2020.
(Continued)

*Primary Examiner* — Zhen Y Wu
(74) *Attorney, Agent, or Firm* — Quarles & Brady LLP

(57) ABSTRACT

A fall detection system includes a plurality of sensors in which at least one of the sensors is coupled to or disposed near a floor. The fall detection system further includes a central monitoring system in signal communication with the plurality of sensors. The central monitoring system is configured to receive a response signal in response to an activation signal being transmitted from at least one of the
(Continued)

plurality of sensors, and determine whether the response signal is indicative of a person being arranged in a prone position on the floor.

26 Claims, 15 Drawing Sheets

(58) Field of Classification Search
USPC ..... 340/573.7
See application file for complete search history.

(56) References Cited

U.S. PATENT DOCUMENTS 8,179,268 B2 * 5/2012 Gannot ..... G08B 21/0438 340/573.1
8,432,169 B2 4/2013 Niwa
8,634,816 B2 1/2014 Xiao
8,952,818 B1 * 2/2015 Zhang ..... G08B 21/0492 340/573.1
9,691,252 B2 * 6/2017 Desgorces ..... G08B 21/043
10,416,331 B2 * 9/2019 Casimiro ..... H03K 17/955
2003/0001755 A1 * 1/2003 Tiernay ..... G07B 15/063 340/928
2003/0052783 A1 * 3/2003 Sitzman ..... H01Q 1/2216 340/572.7
2004/0229696 A1 * 11/2004 Beck ..... A63H 3/28 463/40
2005/0209828 A1 9/2005 Blosser
2006/0001545 A1 * 1/2006 Wolf ..... G08B 21/0461 340/573.1
2007/0115118 A1 * 5/2007 Hsu ..... G08B 3/10 340/541
2007/0159332 A1 * 7/2007 Koblasz ..... G08B 21/0275 340/572.1
2007/0198850 A1 8/2007 Martin
2008/0238682 A1 * 10/2008 Kuwako ..... H01Q 1/2216 340/572.4
2009/0088605 A1 4/2009 Ross
2010/0117798 A1 * 5/2010 Jenkins ..... H04Q 9/00 340/10.1
2012/0262294 A1 * 10/2012 Nikolovski ..... G08B 21/043 340/565
2012/0314901 A1 * 12/2012 Hanson ..... A61B 5/1117 382/103
2013/0000228 A1 * 1/2013 Ovaert ..... E04F 15/22 52/173.1
2013/0143519 A1 * 6/2013 Doezema ..... G08B 21/043 455/404.2
2013/0293068 A1 * 11/2013 Nishida ..... H02N 2/186 310/339
2013/0307696 A1 * 11/2013 Booij ..... G01S 5/021 340/686.6
2014/0266704 A1 * 9/2014 Dalley, Jr. ..... G08B 21/18 340/539.13
2015/0235066 A1 * 8/2015 Hattori ..... G06K 7/10128 340/10.1
2015/0276963 A1 * 10/2015 Casimiro ..... G01V 3/088 324/658
2015/0277540 A1 * 10/2015 Jackson ..... G06F 3/03547 345/169
2015/0379851 A1 * 12/2015 Diels ..... G06K 9/00771 340/573.1
2016/0203692 A1 * 7/2016 Ten Kate ..... A61B 5/681 340/573.1
2016/0217664 A1 * 7/2016 Bradford ..... E04F 15/02
2016/0328941 A1 * 11/2016 Sundholm ..... G08B 25/006
2016/0378235 A1 * 12/2016 Dow ..... G06F 1/163 345/174
2017/0005958 A1 * 1/2017 Frenkel ..... H04L 51/046
2017/0077588 A1 * 3/2017 Fukuda ..... G06Q 10/08
2017/0354350 A1 * 12/2017 Di Croce ..... A61B 5/1117
2018/0003847 A1 * 1/2018 Casimiro ..... G01V 3/088

OTHER PUBLICATIONS

International Searching Authority, International Search Report & Written Opinion for application PCT/US2017/038794, dated Nov. 3, 2017.

* cited by examiner

PROXIMITY BASED FALL AND DISTRESS DETECTION SYSTEMS AND METHODS

CROSS-REFERENCE TO RELATED APPLICATIONS

This application represents the national stage entry of PCT/US2017/038794, filed Jun. 22, 2017, which claims benefit of U.S. Provisional Application 62/354,044 filed Jun. 23, 2016. The contents of these applications are hereby incorporated by reference as set forth in their entirety herein.

BACKGROUND OF DISCLOSURE

The present disclosure generally relates to proximity based distress and fall detection systems and methods, and more specifically, to fall detection systems and methods utilizing proximity (to the floor/ground) based upon centralized computing and monitoring for determining when a person has fallen or is in positional distress.

Falls occurring within a person's home, a continuing care retirement facility (e.g., an eldercare facility) or other similar facility are frequently reported medical or emergency events, carrying high societal costs. Morbidity and negative outcomes tend to increase the longer an elderly person remains unrecovered from the fallen condition.

Current fall detection systems suffer from a variety of drawbacks. For example, some fall detection systems rely upon highly sophisticated wearable devices that use a multitude of sensors and mobile computer processing. To determine whether a person has fallen, electronics embedded in the mobile devices continuously analyze and determine device orientation (with respect to gravity) or whether the devices have experienced certain classes of movements. The constant processing and sensing requires considerable power that must be managed. Even if managed, the storage for this power in battery form adds weight, often doubling or tripling the weight of the device. The reliability of these devices can also be limited due to their complex algorithms for determining movement or distance. The current devices require complex communication systems to summon assistance when a person has fallen or is on the floor. Other fall detection systems require users to manually activate an input to summon assistance. If the user is unable to activate the input, no assistance is summoned, leaving the person in a dangerous situation.

There is accordingly a need for improved distress detection and fall detection systems and methods. The approach described here is largely based on the simple concept of determining if someone is "on the floor." This "on the floor" determination is made by a central monitoring system, and not by the body worn device; thus, the body worn device is simple, small, and reliable.

SUMMARY OF DISCLOSURE

In one embodiment of the present disclosure, a fall detection system includes a plurality of sensors at least one of which is coupled to or disposed near a floor. Each of the sensors is configured to transmit an activation signal. The fall detection system further includes a central monitoring system in signal communication with the plurality of sensors. The central monitoring system is configured to receive a response signal in response to at least one of the activation signals being transmitted from the plurality of sensors and determine whether the response signal is indicative of a person being arranged in a prone position on the floor.

In another embodiment of the present disclosure, a fall detection system includes a wearable transponder, a plurality of antennas and a central monitoring system. The central monitoring system is in signal communication with the plurality of antennas. Each of the plurality of antennas is configured to transmit (a) an activation signal having a range and (b) an interrogation signal having an interrogation range extending beyond a fall detection range. The wearable transponder is configured to not transmit a response signal when the wearable transponder is positioned outside the range of the interrogation signals transmitted by the plurality of antennas. The wearable transponder is further configured to transmit the response signal to the central monitoring system when the wearable transponder is positioned inside the interrogation range of any one of the interrogation signals of the plurality of antennas. The central monitoring system is configured to receive the response signal when transmitted, and based upon the response signal, determine at least one of (a) whether the wearable transponder is operating correctly, (b) whether the wearable transponder is being worn, (c) an identity of a person wearing the wearable transponder, or (d) a location of a person wearing the wearable transponder.

In yet another embodiment of the present disclosure, a method of detecting a fall is provided. The method includes transmitting a response signal based upon feedback from a plurality of sensors disposed on a floor, receiving the response signal at a central monitoring system, and processing the response signal at the central monitoring system to determine whether the feedback from the plurality of sensors is indicative of a person having fallen on the floor.

These and other features, aspects, and advantages of the present disclosure will become better understood upon consideration of the following detailed description, drawings, and appended claims.

BRIEF DESCRIPTION OF THE DRAWINGS

FIG. 8B includes a representation of a person on the floor.

FIG. 9B includes a representation of a person on the floor.

FIG. 10B includes a representation of a person on the floor.

FIG. 11B includes a representation of a person on the floor.

FIG. 12B includes a representation of furniture placed in the room.

Like reference numerals will be used to refer to like parts from Figure to Figure in the following description of the drawings.

DETAILED DESCRIPTION

Many elderly people could benefit from assistance of an eldercare facility, but are reluctant to seek such assistance because of a perceived lack of freedom. Eldercare facilities have responded to this perception by offering different living quarter styles that provide beneficial care to the resident, while allowing the resident to enjoy a substantial degree of freedom and privacy. The possibility of falling and not receiving immediate attention at these facilities, however, poses a serious risk to residents. Eldercare facilities with proximity based fall detection systems that utilize relatively lightweight and non-intrusive wearable devices that operate with centralized processing and monitoring to provide increased protection against falls are therefore needed.

Figure 1:
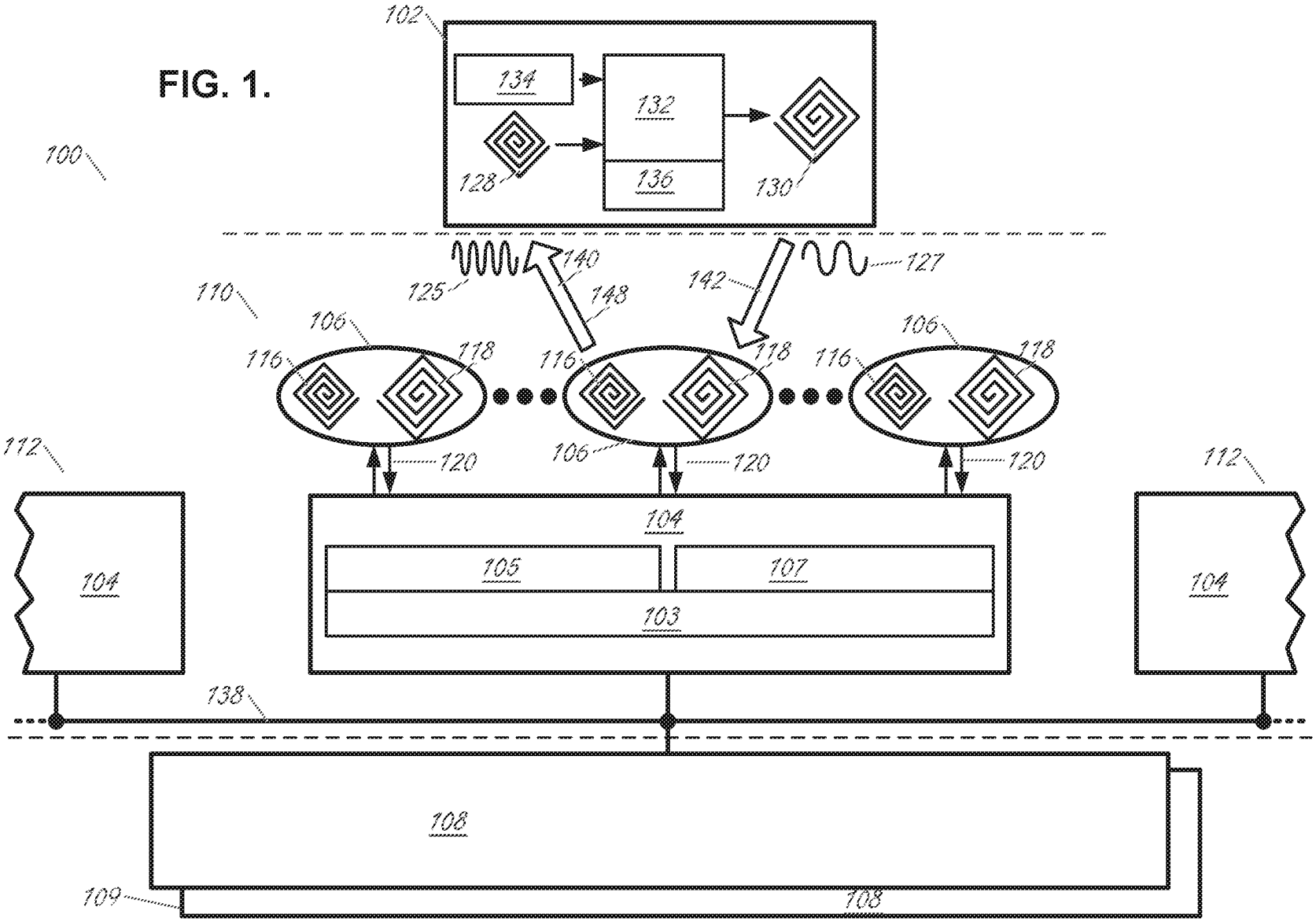
FIG. 1 is a schematic representation of one embodiment of a proximity based fall detection system of the present disclosure.
Figure 2:
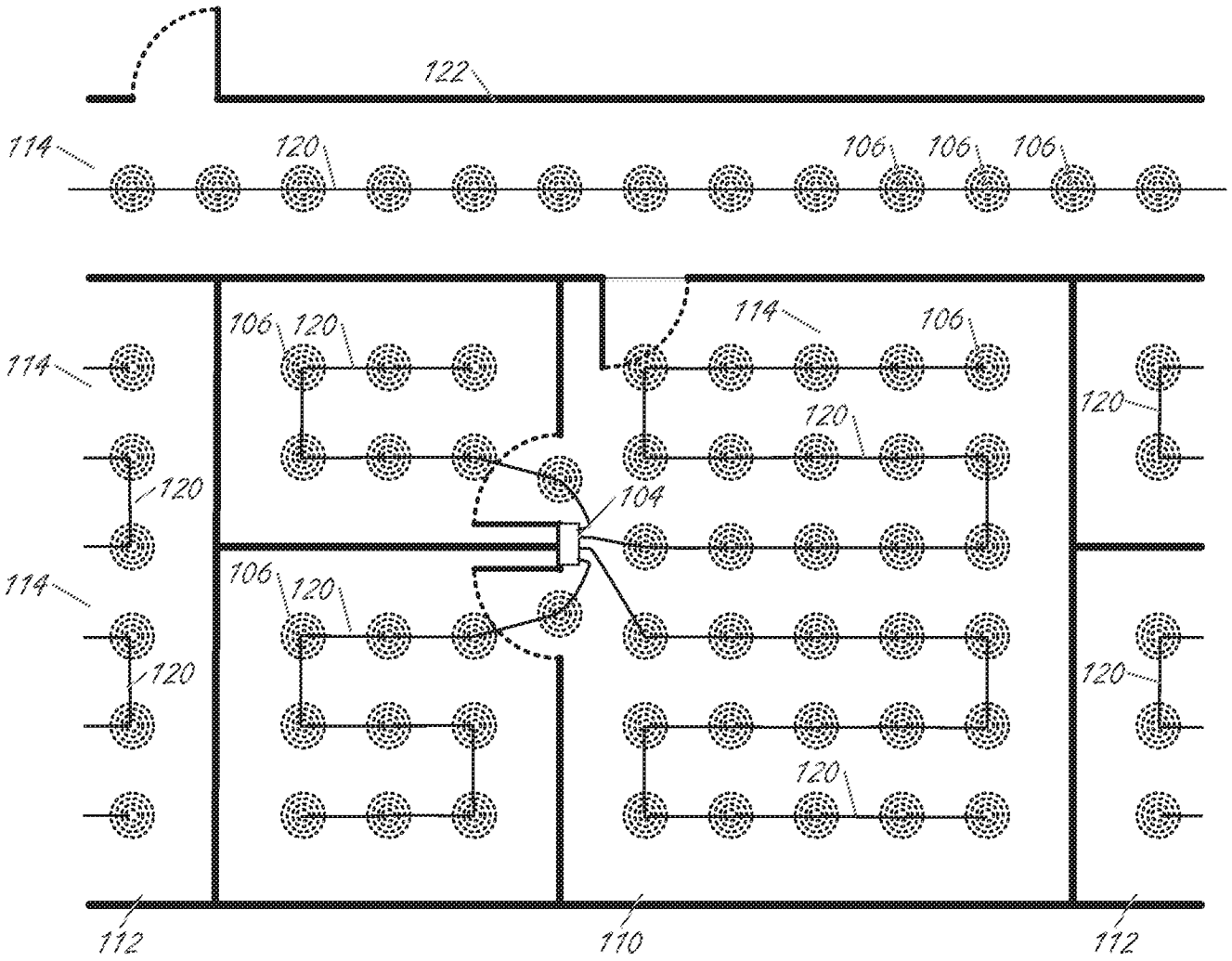
FIG. 2 is a plan view of living quarters within a facility employing the proximity based fall detection system of FIG. 1, depicting the arrangement of several components within the living quarters.

FIG. 1 is a schematic illustration of one embodiment of a proximity fall detection system ("PFDS") 100 for use in an eldercare facility. The PFDS 100 includes a mobile or portable system, which may include a body worn unit 102, a plurality of sensors, e.g., capacitive, inductive, pressure or torque; or communications elements, e.g., transmit and/or receive antennas arranged about a floor, which are referred to generally herein as floor elements 106, one or more relay or communication modules 104, and a central monitoring system 108. The PFDS system is a section of an eldercare facility (a portion of a floor plan of the facility is shown in FIG. 2) for a single resident (not shown) in a single living quarters 110. The partial relay or communication modules 104 located to the left and right in FIG. 1 represent relay modules for adjacent living quarters 112 (see the rooms adjacent to the living quarters 110 in FIG. 2).

The plurality of floor elements 106 can be coupled to, placed on top of, near, or within a flooring surface (not shown) of living quarters 110. In some embodiments, the plurality of floor elements 106 are placed under a flooring surface (e.g., between a carpet layer or tile layer and a sub-floor), while in other embodiments the plurality of floor elements 106 include a flooring cover placed on the floor upon which people can walk. The plurality of floor elements 106 are distributed, for example, in a grid pattern 114 (see FIG. 2 and FIG. 6) to provide proximate coverage over most or all of the floor space of living quarters 110.

The plurality of floor elements 106 may comprise a variety of different configurations. In some embodiments, the plurality of floor elements 106 may include one or more antenna coils or coupling devices. In some embodiments, the plurality of floor elements 106 may include inductive or capacitive coupling devices in conjunction with antennas or other sensing devices. The plurality of floor elements 106 may also incorporate a variety of sensing elements, including magnetic switches or sensors, force sensors or switches, or ultrasonic sensors or devices.

Still referring to FIG. 1, in one embodiment, located at each point of the grid-like pattern 114 is a transmit antenna 116 and a receive antenna 118. Each antenna in the plurality of antennas 106 is individually addressable, and can be driven or excited so as to transmit signals individually. Both the transmit antenna 116 and the receive antenna 118 are electrically coupled to and/or in signal communication with the relay module 104 via electrical or communication signal lines 120 (see FIG. 2), which are illustrated schematically in FIG. 1 as opposing arrows between the grid pattern 114 of elements 106 and the relay module 104. Each transmit antenna 116 and each receive antenna 118 is separately addressable and can be driven individually by relay module 104.

Figure 6A:
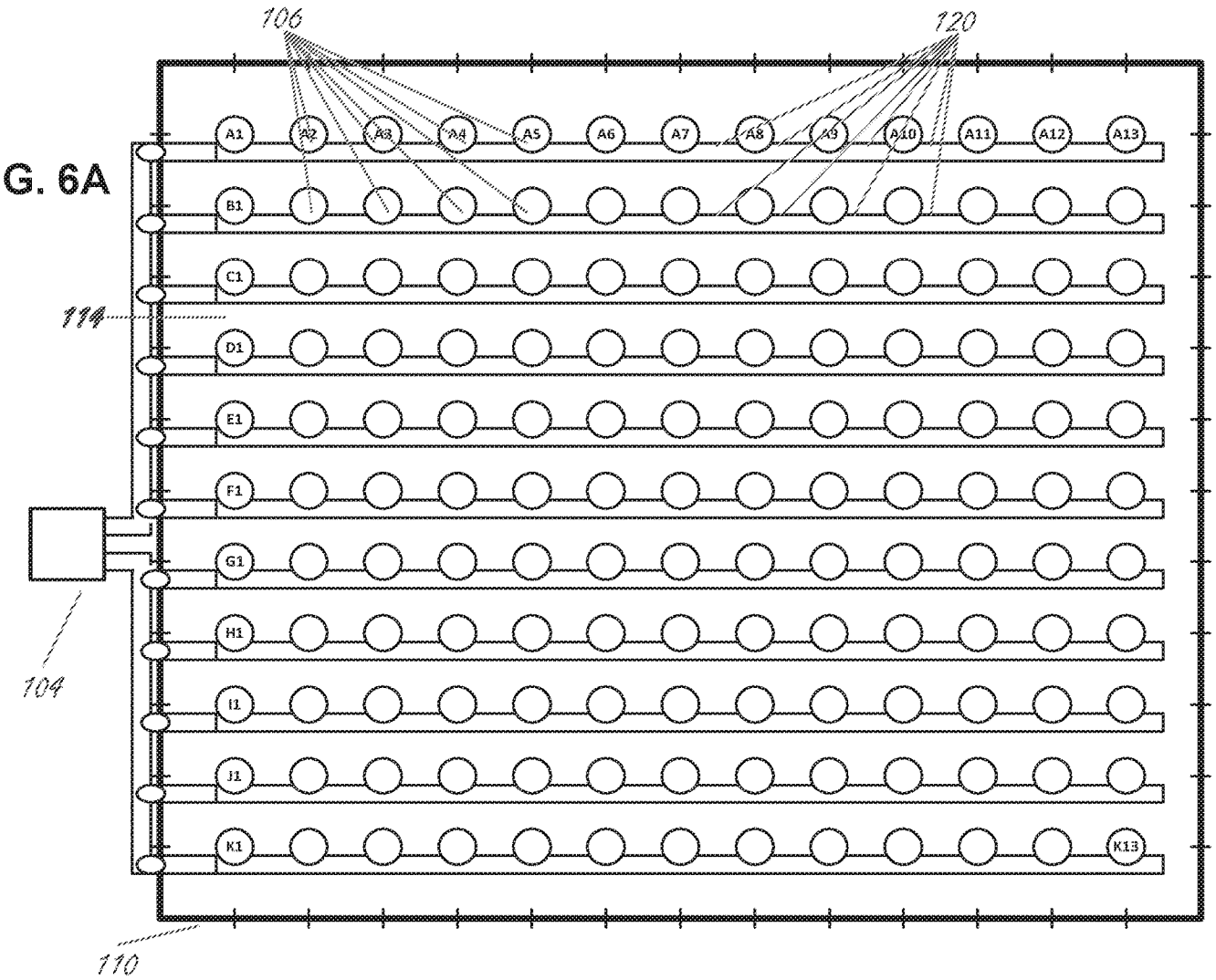
FIG. 6A-6B is a plan view of living quarters within a facility employing the proximity based fall detection system of FIG. 1 and FIG. 2, depicting an alternative layout of the arrangement of the floor elements within the living quarters.
Figure 6B:
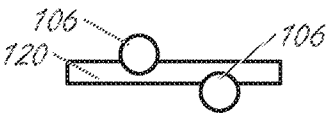

While the plurality of floor elements 106 are illustrated as a grid pattern 114 in FIG. 1 and more particularly, FIG. 6A, it should be appreciated that the plurality of floor elements 106 may be distributed in any pattern suitable for providing coverage to differently shaped rooms or spaces. One such suitable configuration or distribution is illustrated in FIG. 2 in which the plurality of floor elements 106 are distributed in a generally linear fashion in a hallway 122. It should be appreciated that relay modules 104 can be positioned outside the facility and electrically coupled to, or in communication with, the plurality of floor elements 106 positioned outside the facility to provide coverage for the facility's grounds and/or walkways. The plurality of floor elements 106 could be a simple meandering wire or wires to provide area coverage, having a cost advantage. Referring now to FIGS. 1 and 2, the plurality of floor elements 106 for an area are coupled to a relay module 104 through electrical lines 120. The PFDS 100 may include any suitable number of relay modules 104 in signal communication with the central monitoring system 108, and relay modules 104 may be located in a space that is larger than living quarters 110 (e.g., a common room or an apartment). The relay modules 104 may be in wired or wireless signal communication with the central monitoring system 108. In some embodiments, the PFDS 100 may be installed in an existing eldercare facility, and the relay modules 104 may be in signal communication with the central monitoring system 108 through the electrical lines of the facility. The relay modules 104 may include power line networking communications technology, which would allow a relay module 104 to be plugged into an existing electrical wall outlet for providing electrical power to the relay module 104 and to allow network communications 103 between the relay module 104 and the central monitoring system 108. Utilizing the facility power lines for providing power and communications provides flexibility for the PFDS 100, eliminating the need for separate hard-wired power connections or network connections. Such networking can be advantageous, for example, in older facilities in which wireless communication between the relay module 104 and the central monitoring system 108 is unreliable due to the facility infrastructure interfering with modern wireless communication technology. The entire eldercare facility, a person's home, a senior center, or any other building or structure in which fall detection monitoring is desired can be populated with the pluralities of antennas 106 and relay modules 104 so that anyone wearing one of the body worn units 102 can be monitored via a central monitoring system communicating with the floor elements 106 and body worn units 102. Without the body worn units 102, the facility can be monitored for movement with proximity coupled sensors.

The body worn unit 102 in the illustrated embodiment is a wearable transponder that includes an input antenna 128, an output antenna 130, an electronics package 132, and at least one sensor 134. Body worn unit 102 can be worn for long periods of time, and can be relatively small and lightweight to provide a comfortable and less intrusive package for a person wearing the body worn unit 102. Aspects of the body worn unit 102 that impact size and weight are, for example, the simplicity of design and reliability of the communications. One example of a communications technology that the body worn unit 102 can use is near field communications (NFC), which is reliable and requires minimal space. However, an ordinarily skilled artisan would recognize a variety of technologies and short-range (e.g., contact to six feet) wireless communication protocols available that could be used to minimize power consumption and package size for the body worn unit 102.

The body worn unit 102 in the illustrated embodiment also includes a battery 136, which may be disposable or rechargeable. In other embodiments, body worn unit 102 does not include any battery at all, and is instead powered via the transmission energy of the signals transmitted by the plurality of antennas 106, thereby minimizing power consumption of the body worn unit 102 and creating a smaller and less intrusive device.

For the simpler instances of body worn units 102, especially those that either just modify the proximity field, or respond to an RFID-like activation event, no internal power is needed. For those units that require internal power, a variety of battery types can be used. Non-rechargeable batteries are generally one third the size and weight of rechargeable batteries. Alternately, for the same weight, non-rechargeable batteries generally last three times longer than a rechargeable battery. In a home application, the longer running, non-rechargeable battery may therefore be advantageous. In an eldercare facility, where there is routine care by trained support staff, the use of rechargeable batteries may be more advantageous since the long-term cost is lower, and regular charging can be reliably managed. In all cases, it is advantageous to use smaller, thinner batteries, such as button or coin cells, hearing aids, and other small portable electronics. Provisions for a rapid exchange/snap-on type of battery approach, whether rechargeable or not, provides advantages.

Based upon calculations that include worst-case values for multiple factors, the daily mAh requirement will span a 6-12 mAh range. At this use rate, i.e., approximately 90 mAh/week or 380 mAh/month, for example, a "yellow tab," ZA10 zinc/air hearing aid cell 5.8 mm diameter×3.6 mm thick would provide power for at least a week. The larger "blue tab," ZA675 ZA10 zinc/air hearing aid cell, 11.6 mm diameter×5.4 mm thick, would provide power for up to two months. Alternately, a rechargeable button cell such as the Lithium-ion LIR2450 24.5 mm diameter×5.2 mm thickness would provide power for more than a week. The previous three examples are potential embodiments of the battery 136.

Electronics package 132 of body worn unit 102 is constructed and arranged to be as reliable and exhibit as low an energy usage as possible, operating with a low power frequency divider and comparator. Electronics package 132 may communicate with other components employing a variety of different signal processing and communication approaches. In one embodiment, a signal received 125 by input antenna 128 is halved in a divide-by-two implementation of basic signal processing, and output antenna 130 transmits a signal 127 back to the under-floor antennas that is half the frequency of the received signal. It should be appreciated, however, that a variety of different signal processing implementations may be utilized to minimize power consumption and complexity, and that an ordinarily skilled artisan would recognize a multitude of ways in which body worn unit 102 could operate, employing different electrical circuits and components of electronics package 132.

Figure 7A:
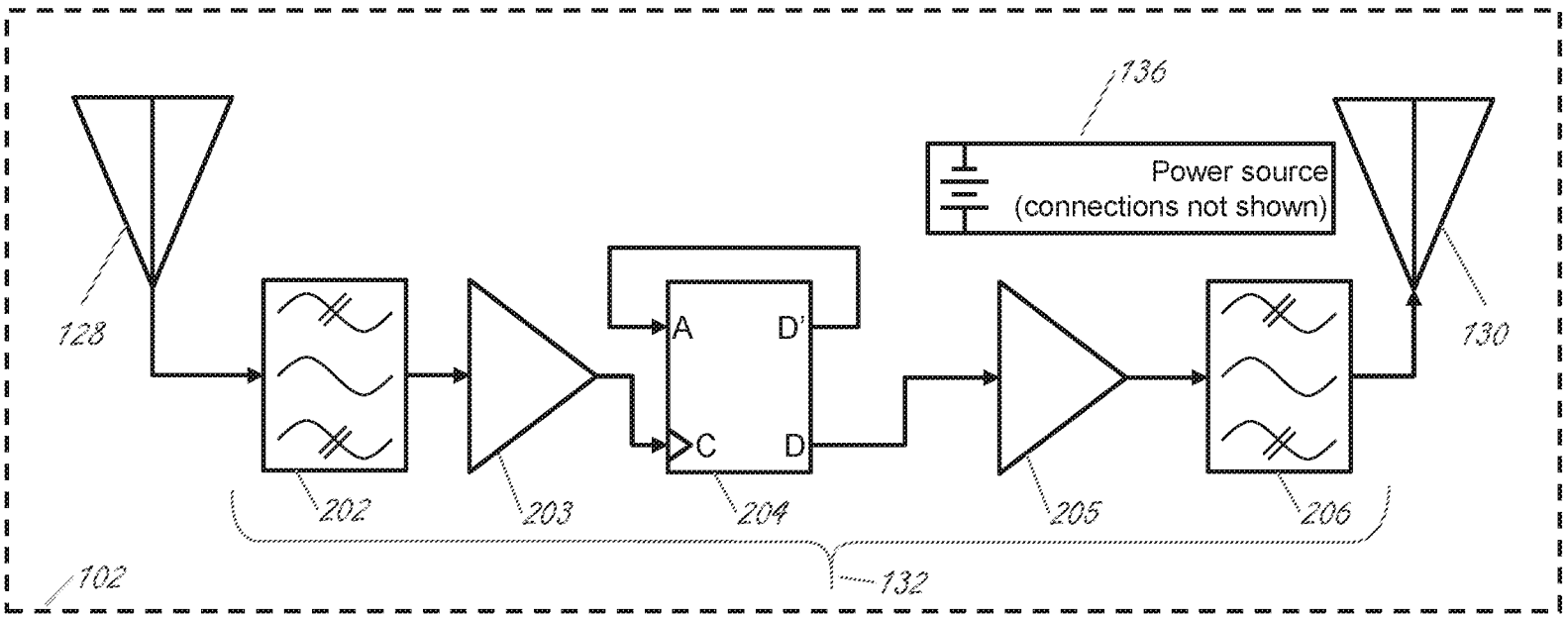
FIG. 7A-7B are schematic representations of a simple frequency divider and a divider with unique identification capability.
Figure 7B:
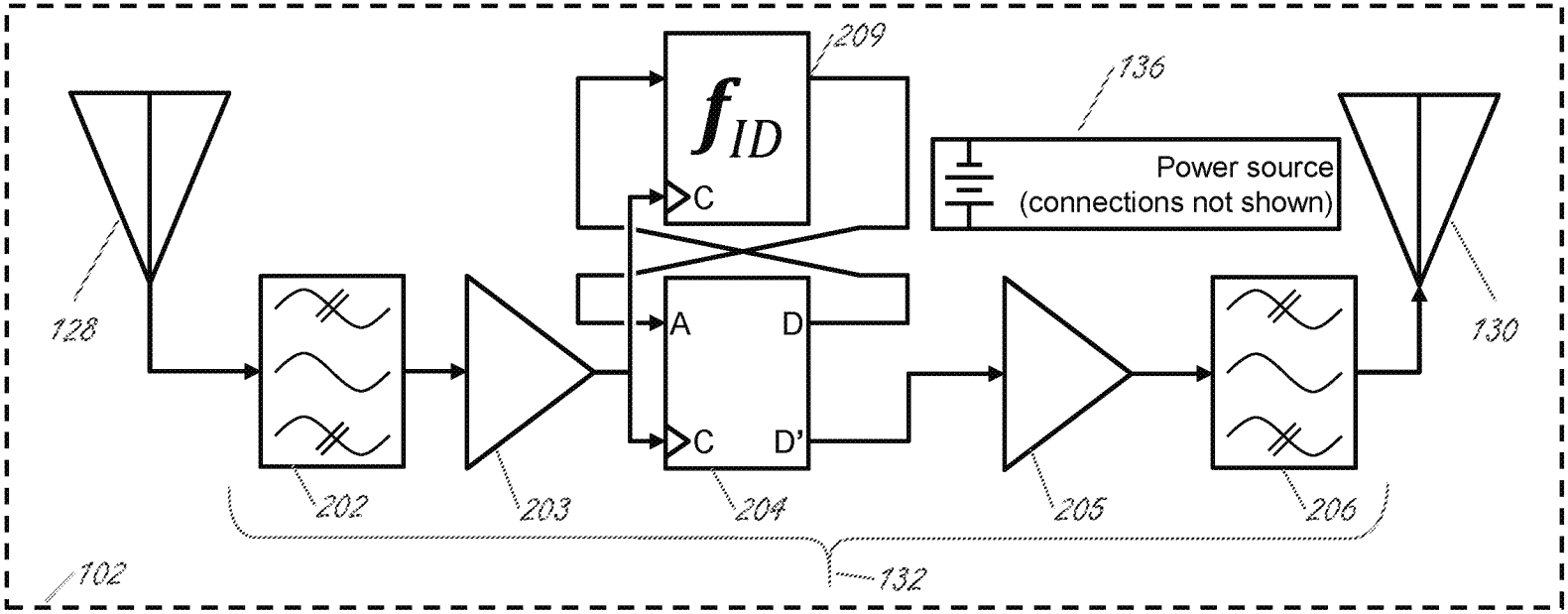
Figure 8B:
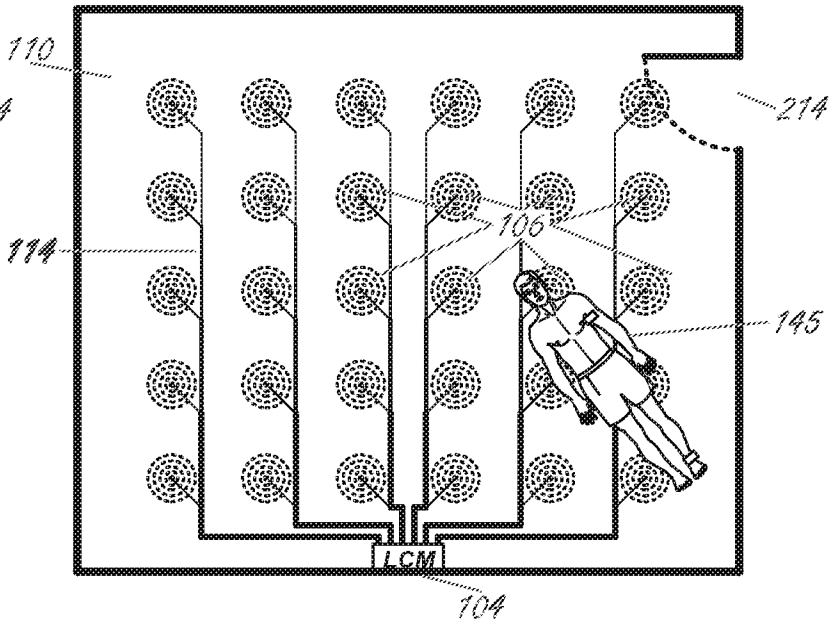
FIG. 8A-8B are plan views of living quarters within a facility employing the proximity based fall detection system of FIG. 1 and FIG. 2, depicting an alternative layout of the arrangement of the floor elements as antennas or coils.
Figure 8A:
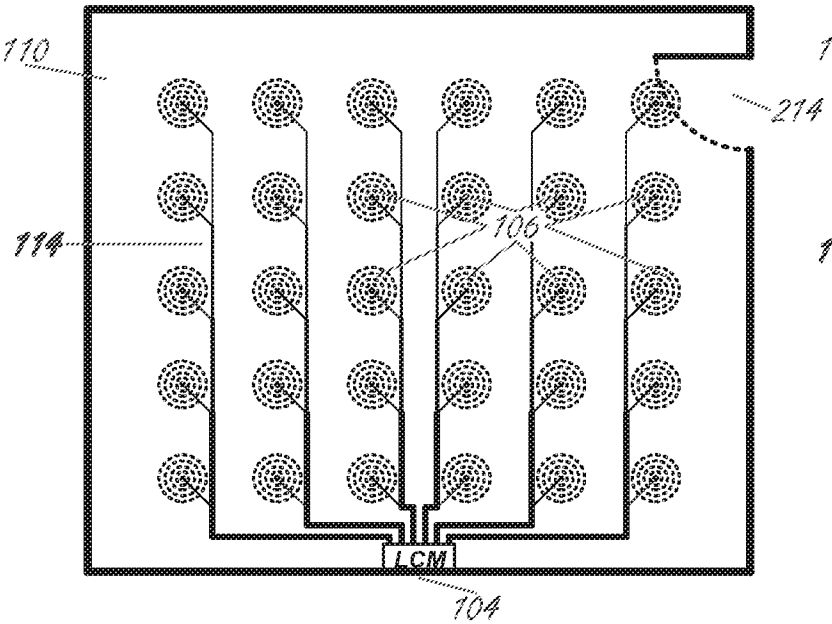

FIGS. 7A and 7B illustrate, in a schematic form, a frequency divider circuit. The input antenna 128 and an input bandpass filter 202 drives a low-power high-gain input amplifier 203, which will output a clipped version of the frequency in the pass-band of input bandpass filter 202. A data flip-flop 204, whose clock is driven by the clipped signal from the low-power high-gain input amplifier 203 and whose inverted data output is fed back into its data input, will toggle each clock cycle—thereby halving the clock frequency. The data output of the data flip-flop 204 drives the input of amplifier 205, which in turn drives the input of the tank circuit 206. The output of the tank circuit 206 drives the output antenna 130.

FIG. 7B additionally has a data encoder 209 implementing, for example, a digital function $f_{ID}$, modulating the toggling feedback to the data flip-flop 204, thereby encoding, for example, the reading from a sensor 134 or the body worn unit 102 identifier. There is little to no signal processing on the body worn unit. The body worn unit 102 will simply return a modified (such as divide by 2) version of the signal that it detects when it is close to the floor. One example would include a pseudo random bit sequence (PRBS) pulse train used to gate the feedback loop. The PRBS signal has a known pattern sequence that the central system sends to the relay module and in turn into the under-floor antennas, so that the central system will "know" exactly what PRBS sequence to expect in the return signal. For example, the returned divided-by-two signal would have the same PRBS sequence; the difference will simply be that the signals are at a different divide-by-two frequency. These types of signals can be processed in such a way as to allow them to be detected even in the presence of electrical background noise. Another approach would be to have the central system send a chirped signal to the relay module (one that has an intentional frequency shift), in which case the returned divided-by-two signal would thus also be chirped, but simply at half the rate, due to the divide-by-two function. This approach also allows the signal to be detected more easily because now the signal is spread across a larger portion of the frequency spectrum, whereas interference is generally at a fixed frequency. To implement the PRBS or chirp approaches, the device does not need any specific new components; the components simply need to have sufficient bandwidth to handle the modulation and/or the frequency shift.

An ordinarily skilled artisan would also recognize that a variety of different low power options could be used to maximize reliability and minimize cost, complexity and signal interference (e.g., from RFID frameworks available from common commercial sources).

Central monitoring system 108 includes at least one computer having at least one processor (or controller) and at least one memory device that stores instructions (or software) for execution by the at least one processor. Central monitoring system 108 can also include a display device operating with the processor to display outputs such as alerts, alarms, notifications, locations, or any other relevant information. Central monitoring system 108 is in signal and/or electrical communication (depicted by network lines 138 in FIG. 1) with a network of relay modules 104, each of which is coupled to a plurality of floor elements 106. The communication between central monitoring system 108 and relay modules 104 can be wired or wireless. In one embodiment, central monitoring system 108 includes software configured to process return or response signals to determine at least one of (i) whether a person wearing the body worn unit 102 has fallen, (ii) whether a person is wearing the body worn unit 102, (iii) other diagnostic medical conditions of a person wearing the body worn unit 102 or any other suitable information. In some embodiments, central monitoring system 108 includes a redundant or back-up computer or system, as illustrated by the second rectangle in FIG. 1 labeled 108. The back-up or central monitoring system can be remotely located from the relay module 104 and plurality of floor elements 106. For example, in one embodiment, one or more relay modules 104 and pluralities of floor elements 106 are deployed in an elderly person's private residence, while the back-up and/or central monitoring system can located at another location remote from the residence.

The PFDS 100 can be designed according to a variety of operational workflows to determine when a person has fallen or is otherwise lying or prone on the floor. As used herein, a person being "prone" refers to a person being in a non-upright position, such as following a fall. To be "prone," the person may be lying in any of a variety of positions, including face up, face down, on one side, and the like.

As one example, a person being monitored for fall detection may wear the body worn unit 102 on an upper portion of his/her body. As described, each room in a care facility may have the plurality of floor elements 106 installed, so that many or all areas of the facility have fall detection coverage. In this way, the central monitoring system 108 is in communication with a plurality of relay modules 104, each of which is coupled to one or more of the plurality of floor elements 106. In the event of the person falling down, the body worn unit 102 is in close proximity to at least one of the plurality of floor units 106. The close proximity of the body worn unit 102 to at least one of the plurality of floor elements 106 allows for a coupling of the two that can be detected by or signaled to the central monitoring system 108 through at least one relay module 104. When the central monitoring system 108 detects a coupling or receives a signal, indicating that a coupling between the body worn unit 102 and at least one of the plurality of floor elements 106 has occurred, a fall detection alarm or warning can be issued, and/or a fall location determination can be made. As is shown in FIG. 7B, a body worn device with a unique identification capability would also allow the central monitoring system to determine who has fallen.

Considering the health impact of falling, the importance of detecting a fall is a priority. Therefore, it is contemplated that certain aspects of the PFDS 100 may have redundant or complementary abilities. For example, in some embodiments, the central monitoring system 108 may include a plurality of computers, or may include one or more computers located at the eldercare facility and one or more computers at a remote location as a redundant backup. Further, the communications between the central monitoring system 108 and the plurality of relay modules 104 may be by multiple different protocols or technologies. For example, the primary communications may be by means of purpose-installed; back-up communications may be through a power line network. The relay module 104 would consist of dual electronics 105 & 107 and would be utilize regular building supplied electrical power along with localized battery backup. Further, the plurality of floor elements 106 may include antennas configured to send and receive radio frequency signals and an inductive or capacitive coupling device that acts as a complementary method of fall detection. It is also contemplated that redundant back-up power may be provided to elements requiring electrical power to operate including batteries and/or a separate power source. Thus, the system would have redundancy throughout, including the use of dual body worn units. Redundancy for the central monitoring system 108 is shown as 109 as an interconnected "hot" backup. The plurality of relay modules 104 may include localized battery back-up power along with regular building supplied electrical power.

Turning now to operation of the PFDS 100 depicted in FIG. 1, in one embodiment, the central monitoring system 108 is configured to cause the plurality of floor elements 106 (e.g., comprising transmit antennas 116 and receive antennas 118) to transmit 140 an activation signal 125 (e.g., a low level radio frequency signal) to the body worn device 102, and the body worn device 102 generates a return or response signal 127 which is transmitted back 142 to the receive antenna 118. Communication back to the central monitoring system 108 is through relay module 104. The activation signal 140 can be a low power transmission, for example, utilizing near field communications (NFC) technology, which has a nominal range of about three feet or less. The NFC range is frequency dependent; in one embodiment to detect if someone is on the floor a range of about 6-18 inches is sufficient. The power level required to close the communication link at this distance is nominally 50 mW to 200 mW.

Each antenna of the plurality of floor elements 106 can be individually addressed, which allows central monitoring system 108 to direct the transmission of the activation signal 140 from a specific antenna at a specific location. The activation signal 140 may be transmitted from each transmit antenna 116 individually, and in a sequence. The central monitoring system 108 can follow a sequence until the activation signal 140 has been transmitted from a desired number of the transmit antennas 116, or all of the transmit antennas 116, within the plurality of floor elements 106. The sequence of transmissions of activation signals 140 can be repeated to provide continuous coverage to the living quarters 110. It is contemplated that more than one antenna 116 may transmit the detection signal at a time in some embodiments to help detect a fall sooner. For example, the central monitoring system 108 may activate, through the communication modules 104 or the relay modules 104, two or more transmit antennas 116 that are spaced apart sufficiently (i.e., not adjacent to each other) for transmitting the activation signal 140 at the same time.

The central monitoring system 108 directs the communications module(s) 104 to energize the antennas, but the communications modules 104 themselves can create the waveform(s) that is/are transmitted into the floor-mounted antennas. In one embodiment, there is essentially a division of labor in that the central monitoring system 108 directs the communications module(s) 104 to transmit the signal, but does not direct how or what signal should be transmitted. Alternately, the central monitoring system 108 and the individual communications modules 104 may be pre-programmed with a set of possible signal waveforms, so that the central monitoring system 108 simply needs to tell the communications modules 104 which waveform to transmit, pulled from a "pick list," but the communications modules 104 themselves generate the specific waveform patterns requested. In these embodiments, the central monitoring system 108 is isolated from the need to process the details or characteristics of each individual waveform.

Figure 9B:
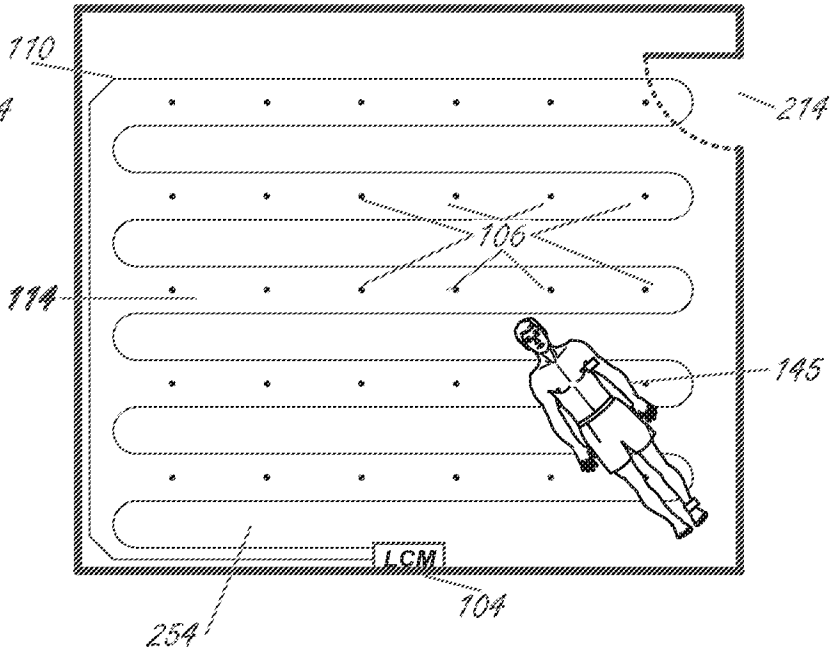
FIG. 9A-9B are plan views of living quarters within a facility employing the proximity based fall detection system of FIG. 1 and FIG. 2, depicting an alternative layout of the arrangement of the floor elements as a single wire loop.
Figure 9A:
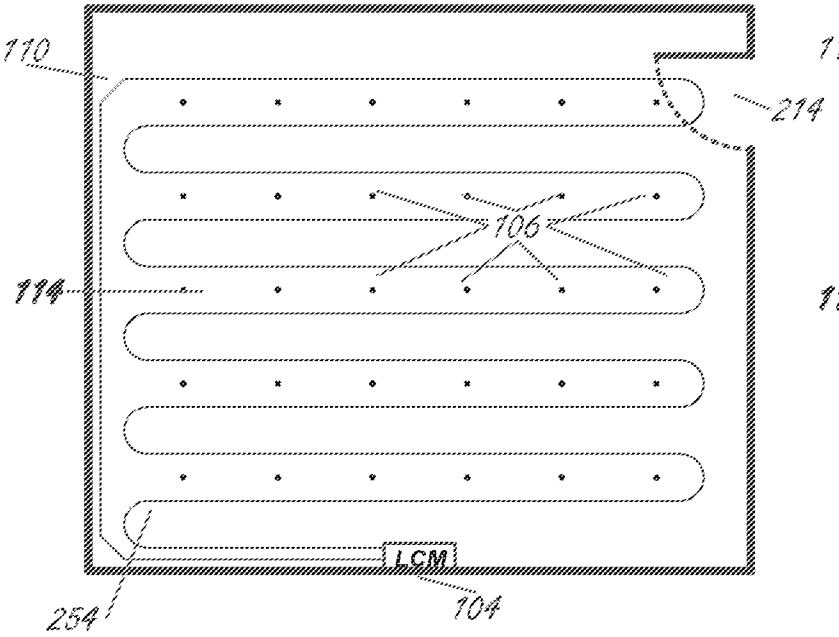
Figure 10B:
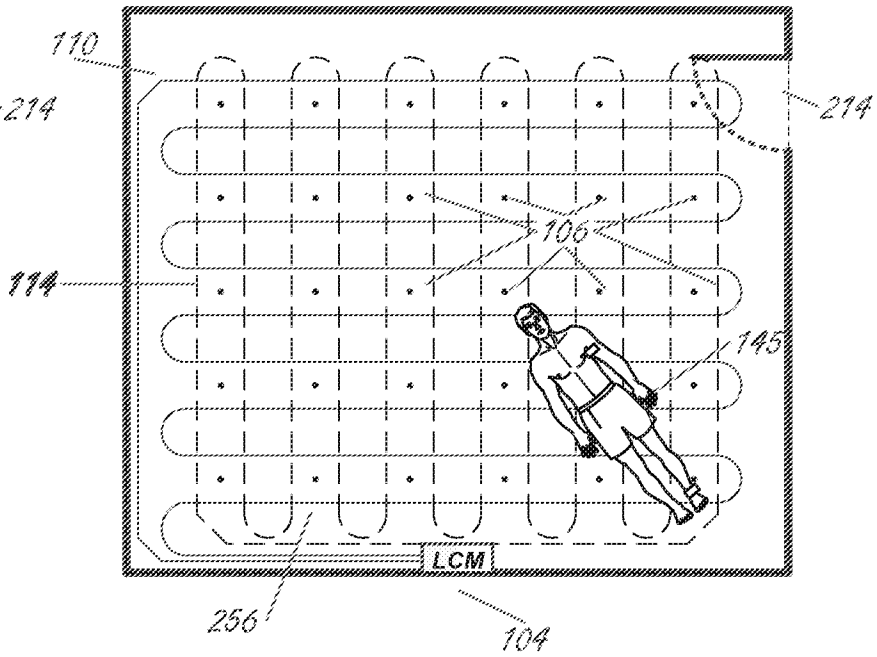
FIG. 10A-10B are plan views of living quarters within a facility employing the proximity based fall detection system of FIG. 1 and FIG. 2, depicting an alternate layout of the arrangement of floor elements as dual orthogonal wire loops.
Figure 10A:
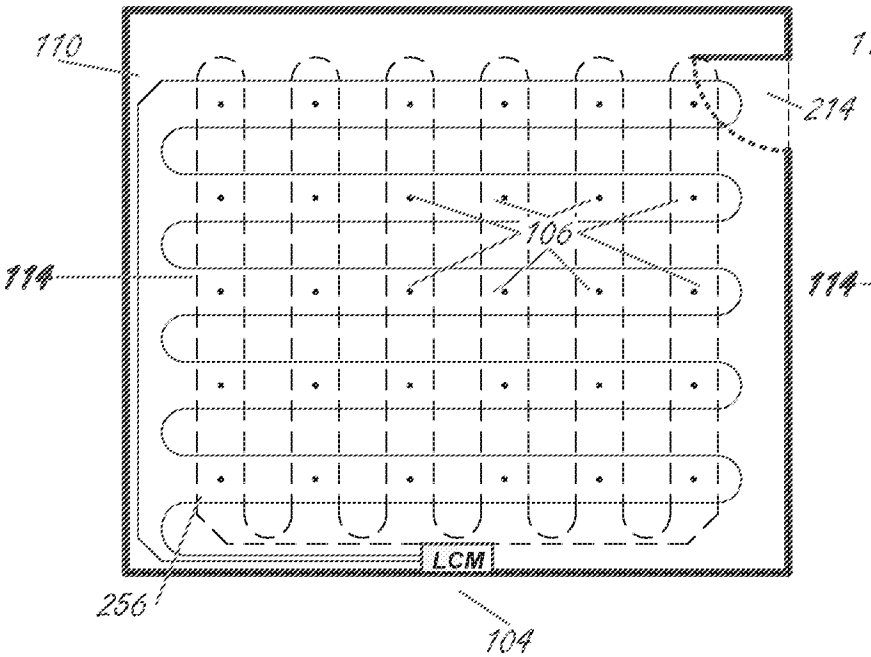
Figure 11B:
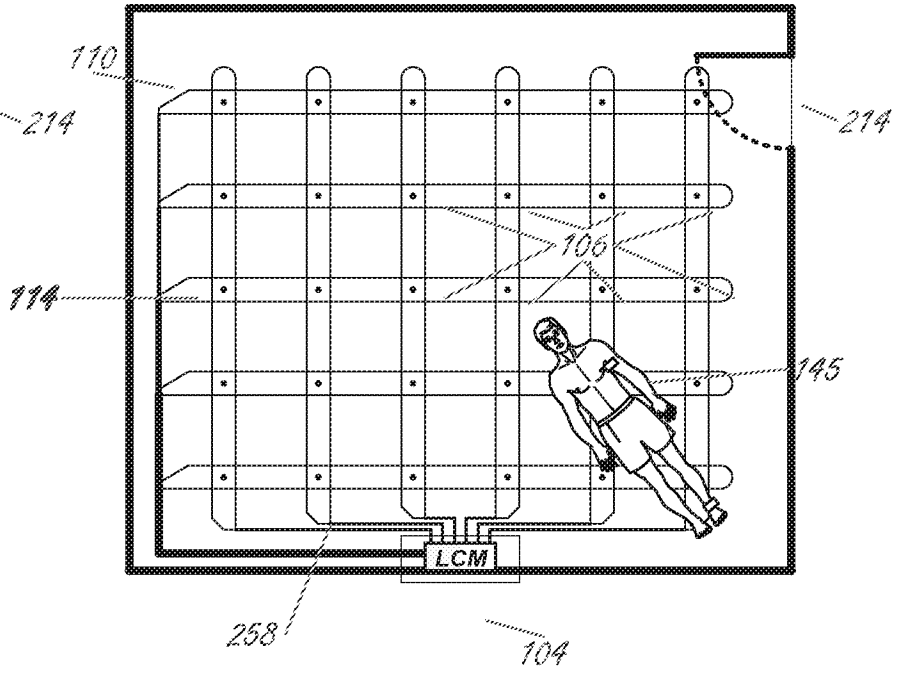
FIG. 11A-11B are plan views of living quarters within a facility employing the proximity based fall detection system of FIG. 1 and FIG. 2, depicting an alternative layout of the arrangement of floor elements as multiple orthogonal wire loops.
Figure 11A:
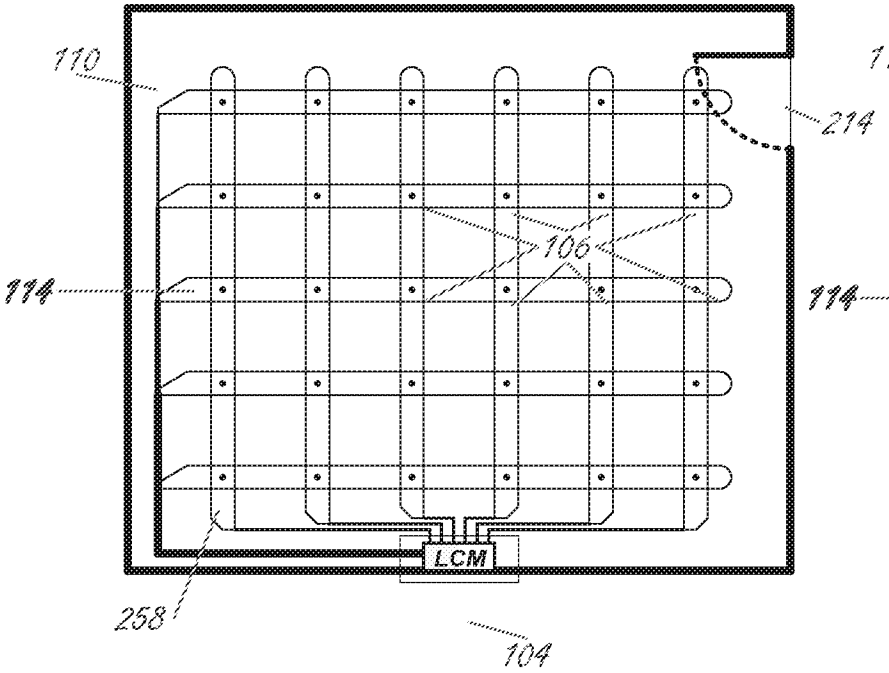

As shown in FIGS. 6A and 9-11, the addressability of different areas of the living quarters 110 can be achieved using a single wire loop 254 that can be located, for example, under carpet or linoleum, which is illustrated at FIGS. 9A and 9B. It can also be achieved, as shown in FIGS. 10A and 10B, using dual orthogonal wire loops 256, or Multiple Orthogonal Wire loops 258, as shown in FIGS. 11A and 11B. FIGS. 9A, 10A, and 11A show the room 110 unadorned by either furniture or bodies 145. FIGS. 9B, 10B, and 11B each add a person 145 close to floor in an identifiable location within the room 110.

Figure 3A:
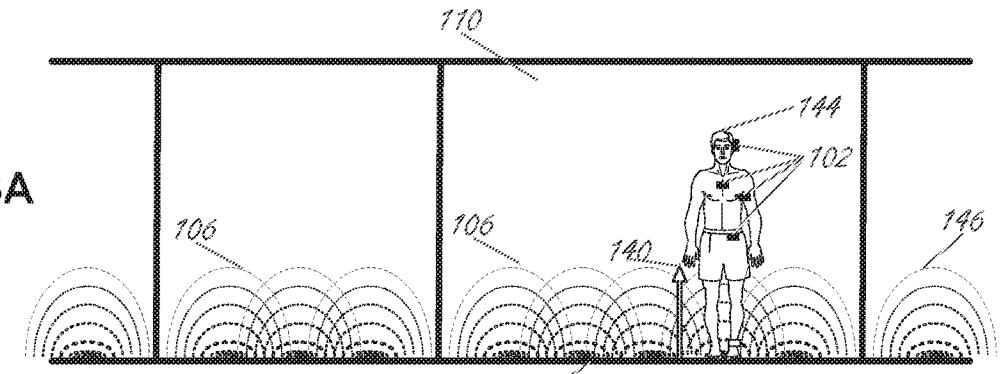
FIGS. 3A-3C are side elevational views depicting a person in a variety of states within the living quarters of FIG. 2 employing the proximity based fall detection system of FIG. 1.

As shown in FIG. 3A, during a normal or non-fall condition, the body worn unit 102 is positioned outside a predetermined range or strength of an activation signal 140 transmitted by at least one of the plurality of floor elements 106. When the body worn unit 102 is outside the predetermined range of activation signal 140, the body worn unit 102 does not receive or process activation signal 140. In other words, when body worn unit 102 is positioned outside the range of signal 140, the body worn unit 102 does not transmit any response signal 142. For example, when a person wearing the body worn unit 102 is sitting or standing, the body worn unit 102 is positioned outside of the predetermined range of the activation signal 140 and the strength of activation signal 140 is too weak for the body worn unit 102 to detect and transmit a response signal 142.

When the body worn unit 102 is positioned within the predetermined range of the activation signal 140 transmitted by one or more of transmit antennas 116, the activation signal 140 is received by input antenna 128 and received by the electronics package 132, which can in turn take data from the sensor 134 and produce a response signal 142 to be transmitted, for example, through output antenna 130. The response signal 142 is received by at least one receive antenna 118 of the plurality of floor elements 106, and passed to the central monitoring system 108 through or via, for example, relay module 104. The central monitoring system 108 receives the response signal 142 and processes the signal and determines or generates an output indicative of a fall occurring (and where the fall took place) by a person wearing the body worn unit 102. The output can include, for example, one or more of audible, visual, or tactile signals indicative of a person falling. The visual signal can be delivered, for example, through the display of the central monitoring system 108, and an audio signal can be delivered, for example, through an audio device operable with the central monitoring system. It should be appreciated that in various embodiments, the response signal 142 need not include any data from sensor 134 and sensor 134 need not be included in the transponder 102.

In various embodiments, the PFDS 100 is configured to determine the location and identification of a person that has fallen, for example, based upon the response signal. In one such embodiment, the body worn unit 102 may include a personal identifier or coded information that is specific to the person wearing the body worn unit 102. The personal identifier may be programmable into the body worn unit 102, or it may be hard coded into the body worn unit 102 so that the central monitoring system 108 can identify the person's body worn unit 102. In one embodiment, the central monitoring system 108 receives signals from multiple antennas 118 so the location of a person can be determined by comparing the strength of response signals 142 from the receive antennas 118 to determine which antenna 118 is closest to the person. The output or determination from the central monitoring system 108 can therefore include both the identification of the person that has fallen as well as the location of the person that has fallen.

In certain embodiments, the PFDS 100 can be programmed with a lag time between the central monitoring system's 108 receipt and processing of response signal 142, and the central monitoring system's 108 generation of an output, alert or notification of a fall detection event. In some embodiments, the lag time or delay allows the person who has fallen time to recover before an alert is generated. In other embodiments, the time delay may be programmed to meet specific needs of a person being monitored. For example, a person with a high risk of injury may have a very short delay time programmed into the central monitoring system 108, while a person with a low risk of falling may have a longer delay programmed into the central monitoring system 108.

It should be apparent from the above description that the PFDS 100 has multiple advantages. For example, processing or detecting of a person's fall at the central monitoring system 108 allows the body worn unit 102 to be less complicated, lighter, and simpler in design. The detection of a person falling relies upon a simple uplink of signals between at least one of the plurality of floor elements 106 and body worn unit 102, which can utilize reliable near-field communication technologies, for example, which have reliable signals over short ranges. The power requirements of the body worn unit 102 can be low because of the design of the PFDS 100 (e.g., due to the computing or processing taking place at the central monitoring system 108).

Figure 3B:
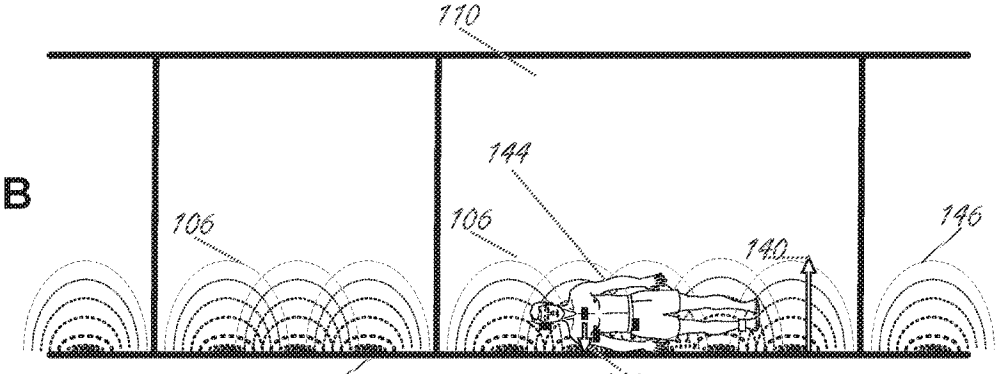
Figure 3C:
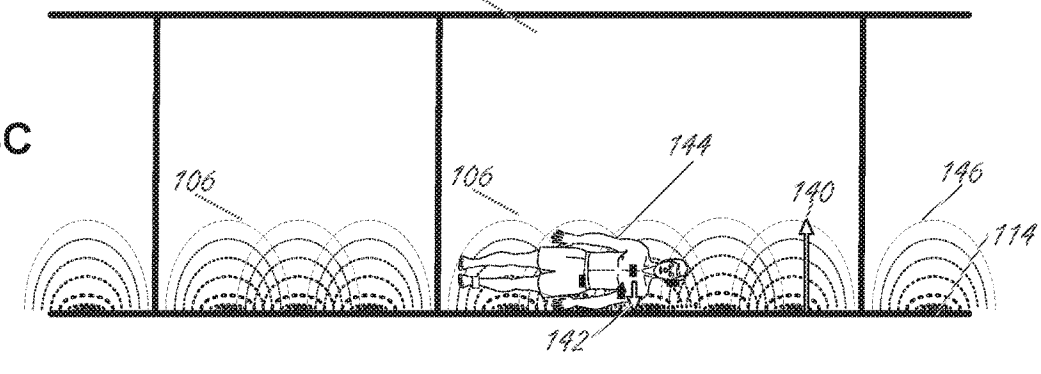

Turning now to FIGS. 3A-3C, a PFDS 100 of the present disclosure is depicted in which a person 144 is experiencing several different conditions or orientations within a room of living quarters 110. The body worn unit 102 is depicted in four possible locations on the person 144—the waist, the chest, the upper arm, and the side of the head. At least one body worn unit 102 needs to be worn by the person 144 for the PFDS 100 to operate, but in some embodiments, the person may wear more than one body worn unit 102 as a back-up unit to ensure a fall is detected, as described in more detail below. The plurality of floor elements 106 have fields of transmission energy 146 having predetermined signal strengths or ranges for detection signal 140. During normal operation of PFDS 100, only one transmit antenna 116 transmits the activation signal 140 at a time. In other embodiments, more than one transmit antenna 116 in the plurality of floor elements 106 transmits the activation signal 140 at a time. The central monitoring system 108 can be connected to a network of relay modules 104, each of which is coupled to a different one or more of the plurality of floor elements 106 to provide fall detection coverage at a plurality of locations. Each of the plurality of floor elements 106, which can be located in a plurality of different locations, may have at least one transmit antenna 116 transmitting the activation signal 140.

FIG. 3A illustrates the person 144 in a standing position in which the body worn units 102 are positioned outside the predetermined range of the activation signal 140 depicted by transmission energy fields 146. In one embodiment, the nominal distance between the floor and the body worn unit 102 is approximately one meter. In other embodiments, however, it should be appreciated that the distance between the floor or location of the plurality of floor elements 106 and the body worn unit 102 can be any suitable distance appropriate for an individual person or persons being monitored at a particular facility or home. The positioning of the body worn unit 102 on the person 144 in some embodiments impacts the strength of the activation signal 140 received, as shown in FIGS. 3B and 3C.

FIG. 3B illustrates the person 144 in a fall position or condition in which the body worn units 102 are located near the floor and are completely immersed in the transmission energy field 146 or predetermined range of the signal 140 (i.e., the body worn units 102 are positioned within the predetermined range of at least one of the detection signals). Signal communication between the central monitoring system 108 and the body worn unit 102 is therefore established. FIG. 3C likewise illustrates the person 144 in a fall condition, but in an orientation opposite to that of FIG. 3B. In the orientation of FIG. 3C, the body worn unit 102 is also immersed in the transmission energy field 146. Signal communication between the central monitoring system 108 and the body worn unit 102 is therefore established. It should be appreciated that the predetermined range of the activation signal 140 needs to be sufficient to immerse the body worn unit 102 in the transmission energy field 146 when a person falls, so that communication can be established between the body worn unit 102 and the central monitoring system 108, regardless of the orientation of the person 144 in the fall condition. In some embodiments, person 144 may wear two or more body worn units 102 to ensure that a fall is detected, regardless of the person's body position after falling. It should be appreciated that the body worn unit 102 needs to be positioned outside of the predetermined range of the transmission energy field 146 (and thus the activation signal 140) when the person 144 has not fallen (e.g., the person is standing or sitting). Shorter people may therefore wish to wear the transponder 102 in a higher position on their bodies, whereas taller people may wish to wear the body worn unit 102 in a lower position on their bodies. It should be appreciated that signal strength or predetermined range of activation signal 140 can be tailored to the physical attributes of the specific person 144 or people being monitored by PFDS.

Figure 4A:
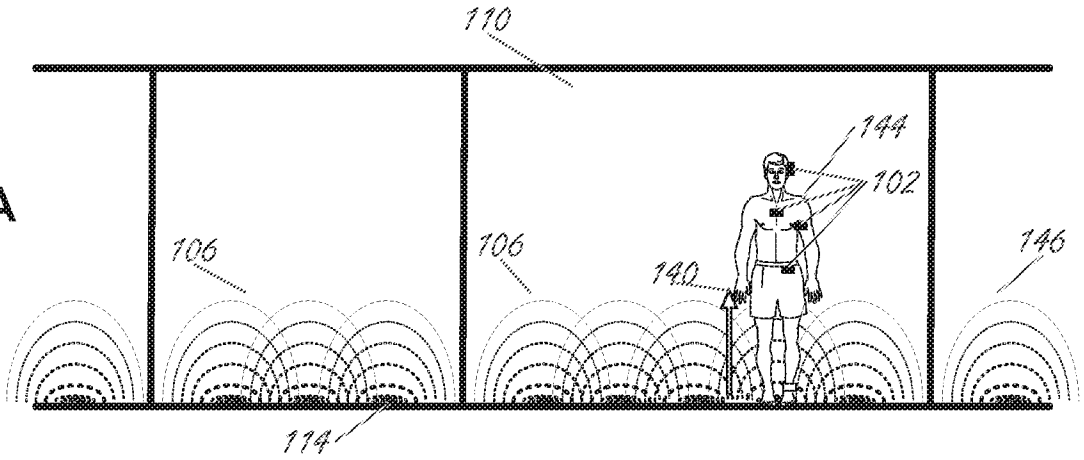
FIGS. 4A-4B are side elevational views of a person within the living quarters of FIG. 2 employing the proximity based fall detection system of FIG. 1, depicting a different mode of operation from FIGS. 3A-3C.
Figure 4B:
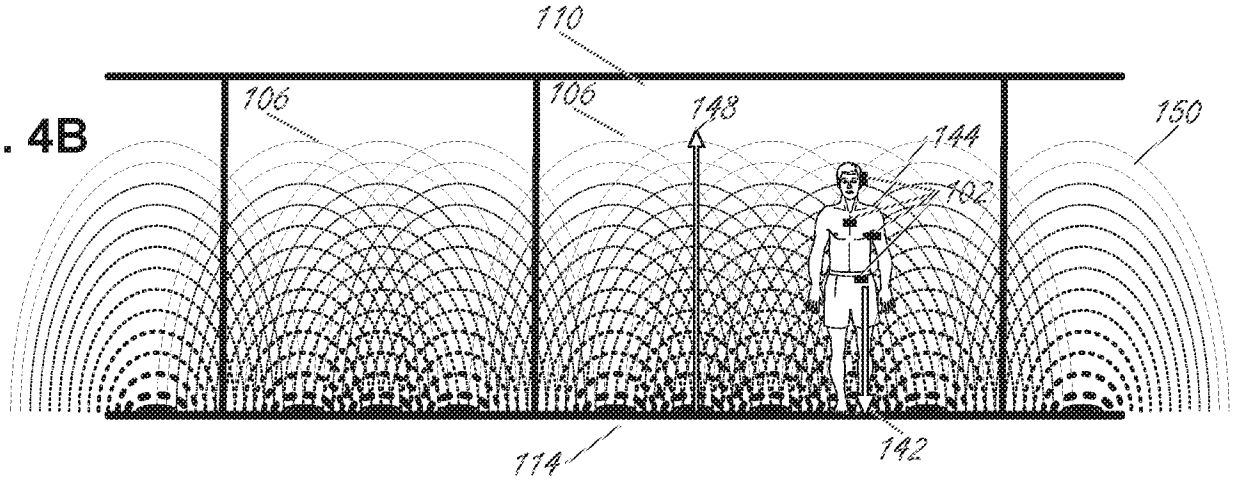

Referring now to FIGS. 4A and 4B, FIGS. 4A and 4B illustrate PFDS 100 operating to determine whether the body worn unit 102 is operating properly. Because central monitoring system 108 does not establish communication with the body worn unit 102 unless a person has fallen, the PFDS could fail to detect a fall condition if the transponder 102 stops operating, or fails. To determine whether the transponder 102 is operating properly, FIGS. 4A and 4B illustrate PFDS operating in an interrogation and fall or normal operating mode.

In particular, FIG. 4A illustrates PFDS 100 operating in the normal or fall detection mode in which activation signal 140 is transmitted by the plurality of floor elements 106 and central monitoring system 108 monitors for any response signal 142. FIG. 4B illustrates the PFDS 100 operating in the interrogation mode in which central monitoring system 108 periodically triggers the relay module 104 transmit electronics for uplink 105 to transmit an interrogation signal 148 (e.g., every fifteen minutes, every half hour, every hour or two hours) to ensure that transponder 102 is working properly. The interrogation signal 148 extends beyond the predetermined range or strength of the signal transmitted by the plurality of floor elements in the normal or fall detection mode. Referring now to FIG. 1, the relay module 104, through its receive electronics for downlink 107 provides the results of the interrogation through communications electronics 103 over the network lines 138 to the central monitoring system 108 and the redundant central monitoring system 109.

It should be appreciated that the interrogation signals 148 illustrated in FIG. 4B can be programmed into the central monitoring system with an interrogation interval suitable for any particular application. In some embodiments, the interval can be as short as five minutes or as long as two hours, and can depend upon a variety of factors such as variable(s) related to the particular person or people being monitored. In one example, shorter durations between interrogations may be more beneficial for facilities where dementia patients are prone to walking off the facility grounds. Facilities in which the risk of a patient walking away is much lower may have longer durations between interrogations.

The interrogation signal 148 in FIG. 4B is illustrated by an extended range of a transmission energy field 150, which is more powerful than the range of the activation signal 140 in the normal or fall detection mode illustrated in FIG. 4A. The transponder 102 in FIG. 4B is immersed in the extended transmission energy field 150 or range regardless of the position or location of the person 144. Increasing the power of the signal to an extended interrogation range allows the body worn unit 102 to receive and process or interpret the interrogation signal 148. In some embodiments, the body worn unit 102 will process the activation signal 140 and the interrogation signal 148 utilizing the same general procedure described with respect to the detection signal. That is, the operation or response of the body worn unit 102 can be the same, regardless of whether the signal is the activation signal or the interrogation signal, allowing for a less complex architecture or design of transponder 102. In other embodiments, the transponder 102 may respond to the interrogation signal with a response signal 142 having additional information or processes. The additional information or processes are discussed in detail below. The response signal 142 transmitted by the transponder 102 in response to the interrogation signal 148 can in an embodiment be similar or the same as the response to the detection signal 140. In other embodiments, the response signal 142 may include additional information from sensor 134.

In some embodiments, the interrogation mode is used to periodically and repeatedly locate a person within an eldercare facility. For example, for patients who are suffering from conditions that affect their mental cognitive ability, the repetition rate of the interrogation signal 148 can be increased to actively track the location of a person within the facility. In other embodiments, the central monitoring system sends the interrogation signal to transmit antennas 116 that are located in close proximity to an entry or exit from the facility so that a person wearing the transponder 102 who is trying to exit the facility can be located promptly.

Figure 5A:
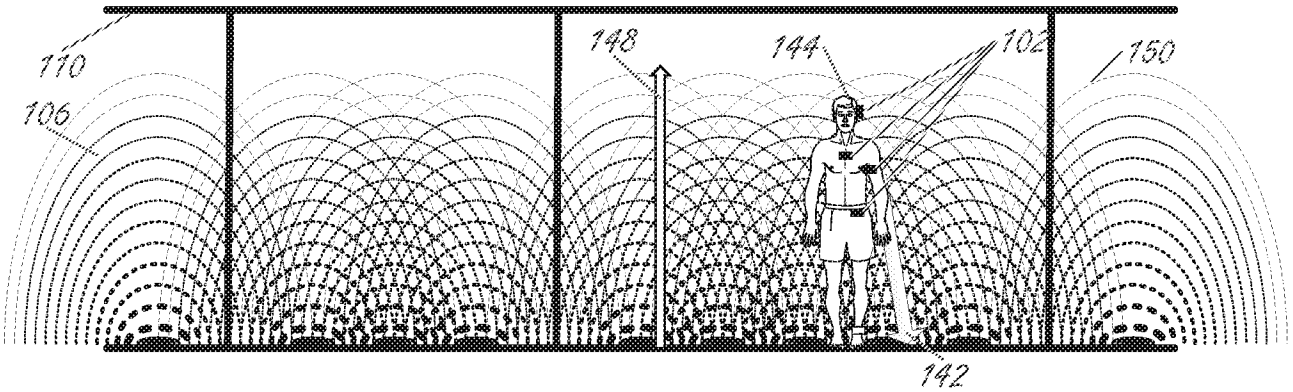
FIG. 5A-5B are side elevational views of a person within the living quarters of FIG. 2 employing the proximity based fall detection system of FIG. 1, depicting different types of signals.
Figure 5B:
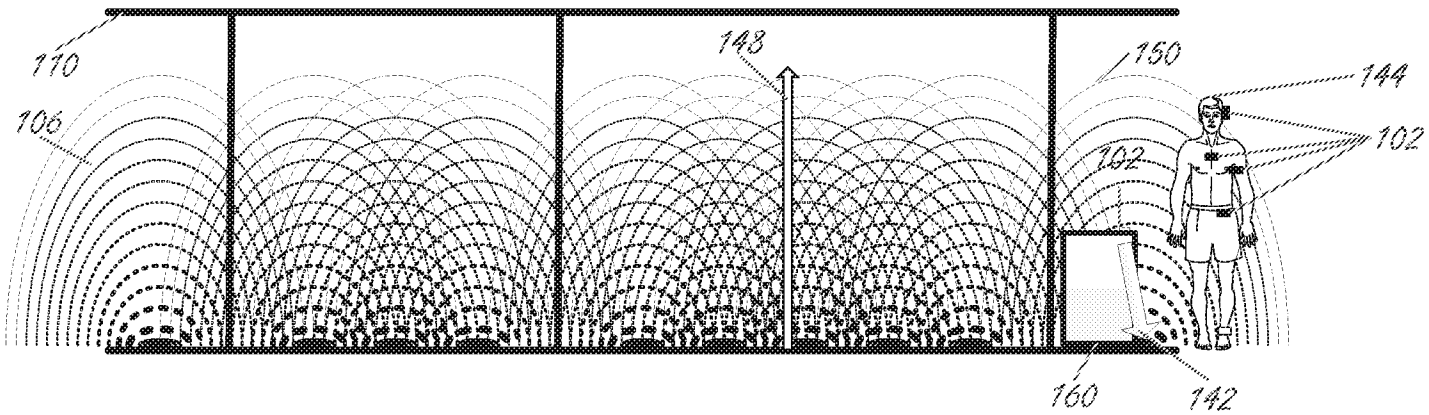

Referring now to FIGS. 5A and 5B, another aspect of the PFDS 100 is depicted. Here, the central monitoring system 108 is configured to determine whether the body worn unit 102 is being worn by person 144. To accomplish this task, the sensor data from the transponder 102 can be utilized. In FIG. 5A, the response signal 142 is depicted in the presence of interrogation signal's 148 extended transmission energy field 150. The response signal 142 may include data from sensor 134. It is contemplated that a wide variety of sensors 134 could be used to provide different types of data. In one embodiment, the sensor 134 could be a temperature probe that measures a skin temperature of the person 144. In another embodiment, the sensor 134 could also be a capacitive proximity sensor. When the response signal 142 includes the appropriate temperature data, the central monitoring system 108 can record the data and process the signal such that an output may be generated, indicating that the body worn unit 102 is operational and being worn. In some embodiments, the determination that the body worn unit 102 is being worn may be accomplished within the electronics package 132 using one of the sensors 134, and a simple flag or marker is included in the response signal 142.

It could be advantageous to know when a person has removed the body worn unit 102. FIG. 5B illustrates a person that has removed body worn unit 102 and placed the body worn unit 102 on a piece of furniture 160. The person may have gone to bed, changed clothes, or about to take a shower. It is contemplated that the data included in the response signal 142 may indicate that the body worn unit 102 is not actively being worn. Thus, the central monitoring system 108 may determine if a body worn unit 102 is removed from the person based upon data from sensor 134 data included in the response signal 142.

The PFDS using temperature sensor data operates in an embodiment as follows. A measured body temperature (a body surface temperature in practice) is compared to the room temperature. Assuming that the surface temperature is a few degrees below core body temperature, any value above, e.g., 32 degrees Celsius (as compared to a nominal room temperature of 25 degrees Celsius) is interpreted by the central monitoring system as the body worn unit 102 being worn. The temperature reading in one embodiment only needs to take place when the interrogation mode is active, and interrogation signal 148 has been received by the central monitoring system 108. In other embodiments, the temperature data could be included in response to the detection signal 140 in the normal or fall detection mode. In yet other embodiments, the power consumption of a temperature measurement could be reduced by measuring the temperature only when needed in response to receiving a detection signal 140 or an interrogation signal 148.

The body-worn antenna and/or coils within the transponder 102 can have dramatically different performance characteristics when the transponder 102 is located on the human body versus off the body. In the off-body case, a resonant antenna or network within the body worn unit 102 would have a very high Q factor value and associated "high peak" response curve. That is, there would be minimal damping on the signal and minimal energy lost. In contrast, when the body worn unit 102 is placed on the body, the resonant structure's Q factor value would decrease dramatically, creating a "low peak" and a broader response curve because of the dampening effects of the human body on the signal. The central monitoring system 108 can therefore detect the differences by changing interrogation amplitudes and/or frequencies to determine the on-body body worn unit's 102 response characteristics. This information can be used to determine passively whether the body worn unit 102 is on or off the body, eliminating the need for a sensor 134 in transponder 102 and further reducing the power requirements and complexity.

It is also contemplated that a number of different types of sensors 134 could be included in body worn unit 102. Some non-limiting examples include optical and non-optical pulse or heart rate monitors and electrocardiogram (ECG) detection. In some embodiments, sensor data can be used for other purposes in addition to determining whether the body worn unit 102 is being worn. For example, the body worn unit 102 could be used to periodically transmit data based on different medical conditions such as tachycardia or bradycardia.

Additional capabilities can be added to the PFDS 100 described above to improve resident care within an eldercare facility. For example, one or more physiological sensing functions, such as motion, heart rate, ECG, respiration, pulse oximetry, etc. can be added to supplement the overall care of the patient or resident. These added sensing functions, along with data logging and data storage for extended periods (one or more weeks) and with the ability to transfer this data (either periodic data snapshots or snippets, or data sets based on "out of predefined operational limits") off of the body worn unit 102 to the central monitoring system 108 will provide the data tier of a multi-tier monitoring system.

In some embodiments, monitoring the motion, or motion plus the ECG monitoring and logging function could be beneficial to help explain why a fall or multiple falls occurred. If a resident experiences a fall, the logged data (which could span durations of hours to weeks) could be offloaded through any of several possible approaches (wireless, wired, etc.), and subsequently analyzed to determine what changes occurred prior to the fall. This data could include changes in posture, or stability, or sleeping patterns, or overall activity, or heart rate and ECG. In effect, a resident's physiological history file could be established to assist in the medical diagnostic processes. In other embodiments, physiological sensing functions such as respiration and pulse oximetry are added or activated on an as-needed basis. It is advantageous for these sensors to consume minimum power to maximize run time; however, there is a tradeoff between power consumed by the sensors, resolution of the data, run time, and battery size. The higher risk residents may have multiple or all of the sensing functions activated, while lower risk residents may require minimal sensing, such as motion only. In some embodiments the physiological monitoring is configurable at the central monitoring system 108 (including sensing types, sample rates and sample resolution) as required by each person 144 who is being monitored.

In some embodiments, the system supports transmission of periodic snapshots of data or snippets through a wireless link to the relay module 104. The relay module 104, which can include or communicate with the electronics and connections for the plurality of floor elements 106, can be enhanced with additional electronics to allow for direct wireless communication with the body worn unit 102. This bidirectional wireless communications link directly to and from the body worn unit 102 may employ different operational frequencies than the frequencies used for fall detection. Alternate frequencies can be employed to account for longer path lengths from the body worn unit 102 to the relay module 104 (e.g., across a room, or from an adjacent room). In addition, the wireless link must be able to transfer significant amounts of data, thereby requiring additional bandwidth. The data snippets can be sent at intervals selected by the facility according to the residents' needs, such as five seconds of data every minute, or five seconds of data every five minutes (again to conserve power), or at other durations and rates as deemed necessary on a resident-by-resident basis. These received snippets can then be transferred from the relay module 104 back to the central monitoring system 108, where the data could be automatically processed to determine if they are within expected normal limits or out-of-range in one or more parameters. Significant deviations from normal ranges could create an alert or notification by the central monitoring system 108.

The PFDS 100 may incorporate technological variations. In some embodiments, the plurality of floor elements 106 may comprise inductive and/or capacitive elements as an alternative to antennas or included with the antennas. An advantage of the coupling detection techniques herein described is that they will operate even in the absence of body worn units 102. In some embodiments, a barrier may be placed under the plurality of floor elements 106 to prevent interference from metal structures in or under the floor (e.g., metal reinforcements in a concrete floor). The antenna coils in the plurality of floor elements 106 may be embossed into plastic sheeting that can be rolled out over a floor in some embodiments. Alternatively, ribbon cables with integrated radiating elements, e.g., antennas, may be used in some embodiments. In some embodiments, the plurality of floor elements 106 may further include capacitive coupling pads that could serve as a secondary fall detection method. When the person 144 is positioned on the floor after falling, the body spans multiple capacitive pads and the capacitance profile detected at the effected pads varies from the long-term state stored in the central monitoring system 108. The central monitoring system 108 may detect this as a variation in measurement and may process the variation in combination with the response signal 142.

Further, in some embodiments wireless communication between the central monitoring system 108 and the body worn unit 102 could include coded sequences, as well as chirped signaling, which allows for robust communication between senders and receivers that share the coded sequence of chip envelope. These coded communications provide signal-processing gain to be achieved at the central monitoring system 108, and assure network security and patient/resident privacy.

A low power optimized processing approach on body worn unit 102 can also be included in certain embodiments so that certain physiological indications automatically initiate a wireless data transfer, instead of, or in addition to, the periodically transmitted snippets noted earlier. For example, an unusually high or low heart rate would automatically initiate a wireless alert, as well as the transmission of perhaps several minutes of previously logged data immediately prior to the out-of-range event. In addition, a fall event could be sensed by the onboard accelerometers, with the automatic generation of a wireless communication that would serve as a backup to the floor proximity implementation, thereby enhancing the PFDS 100 fall detection capabilities in some embodiments.

Alternatively, a fall indication alert can be further communicated by additional methods utilizing some of the above-mentioned features. In addition to the floor-based activation signal 140 and response signal 142 approach described above, the body worn unit 102 may activate the direct wireless communication path (with a fall alert indication) to the wall-mounted relay module whenever it receives the activation signal 140. By means of this mechanism, the mere reception of the activation signal 140, which can be performed in a low power manner; using, for example, a passive crystal RF detector to receive the activation signal 140, activating the normally sleeping wireless circuit on the body worn unit 102 would thereby provide a redundant path to the relay module 104, and from there, using network lines 138, to the central monitoring system 108.

It is also contemplated that the furniture in living quarters 110 may be mapped out during the set-up process and the PFDS 100 could be trained on a one-time basis, or trained over an elapsed time using repeated measurements of the environment, using any of several possible training protocols, to recognize problematic locations. Subsequent deviations from the "trained state" could be used either to initiate a retraining sequence, or to generate a unique alert indicating that specific attention and possibly caregiver attentions should be directed to an analysis of the cause of the change. Alternatively, since each antenna in the plurality of floor elements 106 can be individually addressable, any antennas that are underneath furniture or cabinets and the like may be deactivated in some embodiments if the furniture causes interference issues.

Figure 12B:
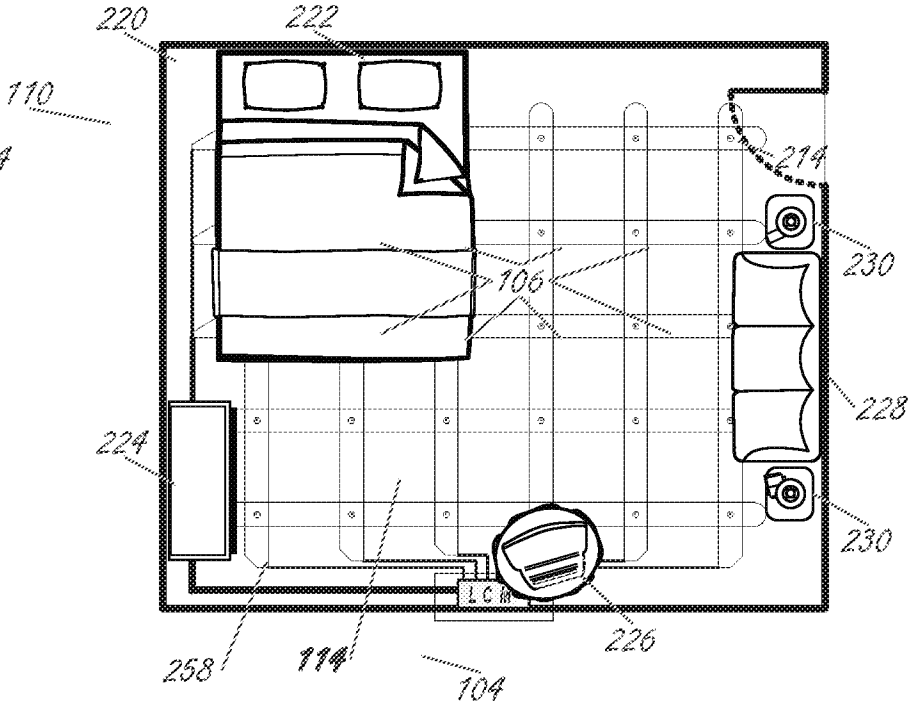
FIG. 12A-12B are plan views of living quarters within a facility employing the proximity based fall detection system of FIG. 1 and FIG. 2.
Figure 12A:
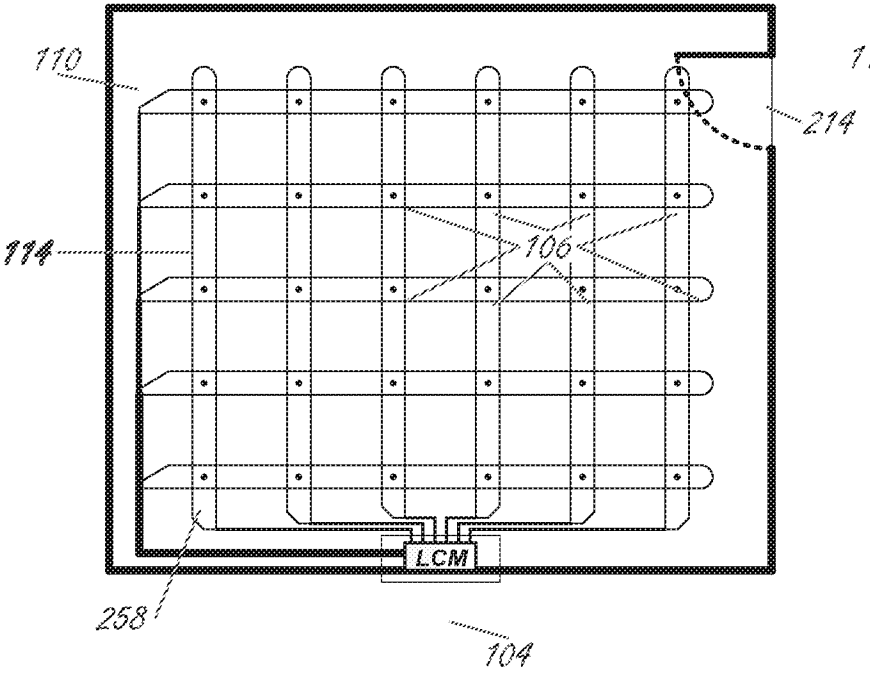

Referring now to FIGS. 12A and 12B, FIG. 12A shows a room 110 monitored by a plurality of floor elements 106, arraigned in the form of multiple orthogonal wire loops 258. It should be understood that for the purposes of illustrating calibration and use, FIGS. 12, 13, and 14 show the multiple orthogonal wire loops 258. However, any of the addressable sensing mechanisms, e.g., floor elements 106 in cooperation with relay modules 104 connected over network lines 138 to the central monitoring system 108, can be used in the sequence shown in FIGS. 12A & B, 13A & B, and 14A & B.

In the environment monitored, there are items that will be detected that are close to the floor, but (over time spans of hours) do not move. As shown in FIG. 12B, these detected items in a furnished room 220 may comprise one or more of a bed 222, a chest of drawers 224, a television on a table 226, a sofa 228, end tables with lamps 230, or other pieces of equipment or furniture. The central monitoring system 108 calibrates for these slow moving items, and may safely reduce the monitoring rate in these detected locations.

In the environment monitored, there are items that will be detected that are close to the floor, but are transitory; these do not signify a reportable problem, however the presence and associated movement as determined by a sequence of close but transitory detection events can be used by the central monitoring system 108 to predict areas that can benefit from more than usual monitoring.

In the environment monitored, there are items that will be detected that are close to the floor but small. These will be calibrated into the baseline. An example may be a falling deck of cards or a ball rolling across the floor. While items such as these may provide notification of the activity in an area, neither is an important reportable item.

Figure 13B:
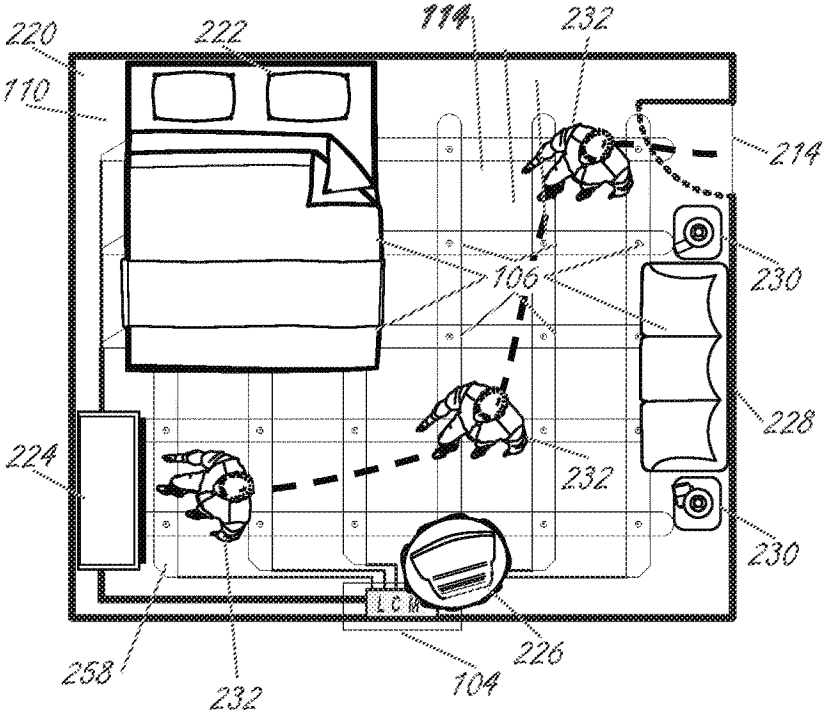
FIG. 13A-13B are plan views of living quarters within a facility employing the proximity based fall detection system of FIG. 1 and FIG. 2, including representations of people moving through the room.
Figure 13A:
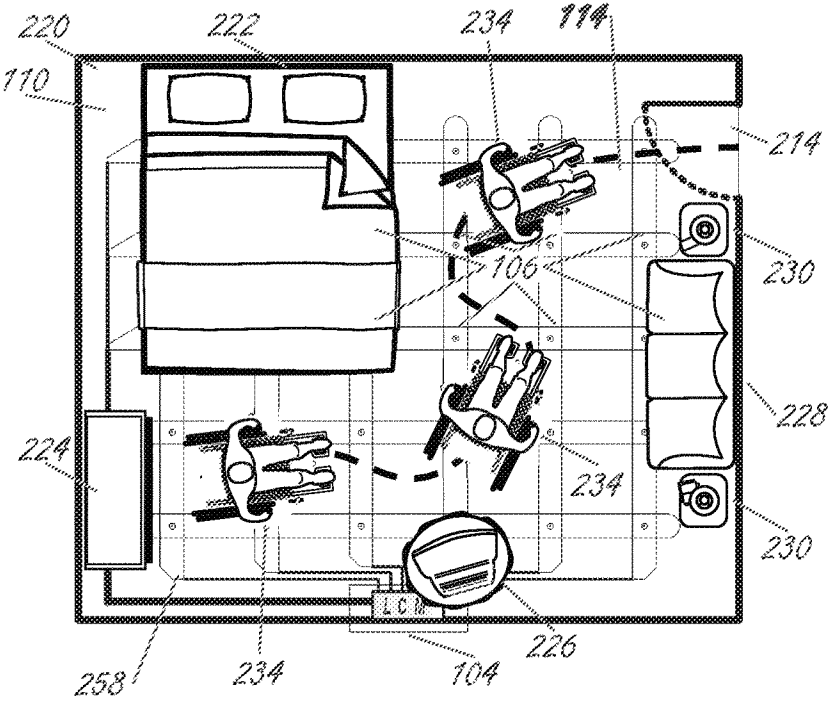

In the environment monitored, there are items that will be detected that are distant from the floor but constant, moving (transitory) or short-term stationary. As shown in FIGS. 13A and 13B, these items may be a person walking 232 through an area, a person in wheelchair 234, a person upright stopping for a conversation. These transitory detection events can be used by the central monitoring system 108 to predict regions that can benefit from more than usual monitoring.

Figure 14B:
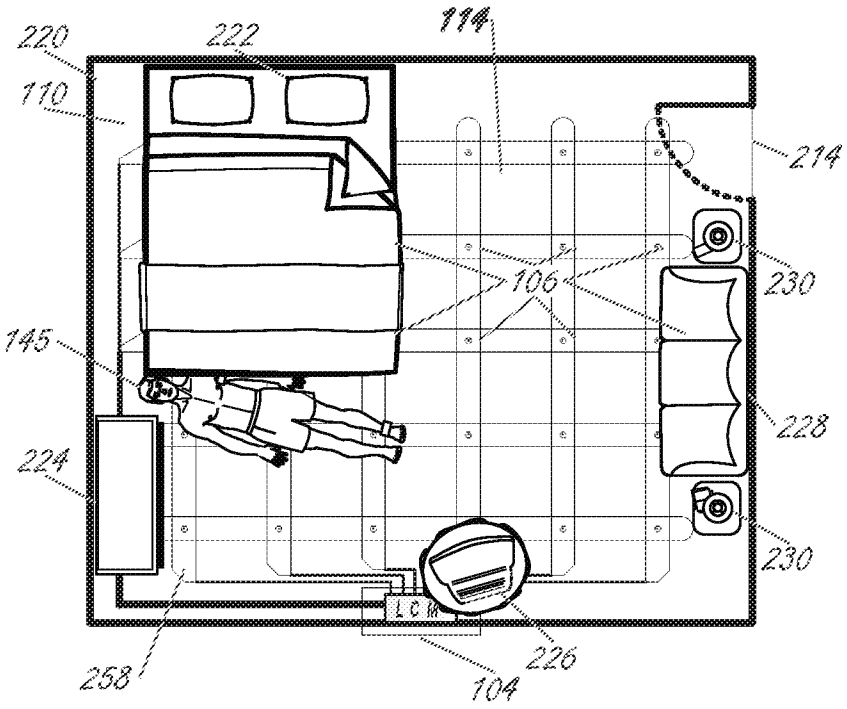
FIG. 14A-14B are plan views of living quarters within a facility employing the proximity based fall detection system of FIG. 1 and FIG. 2, including a representations of a person on the floor.
Figure 14A:
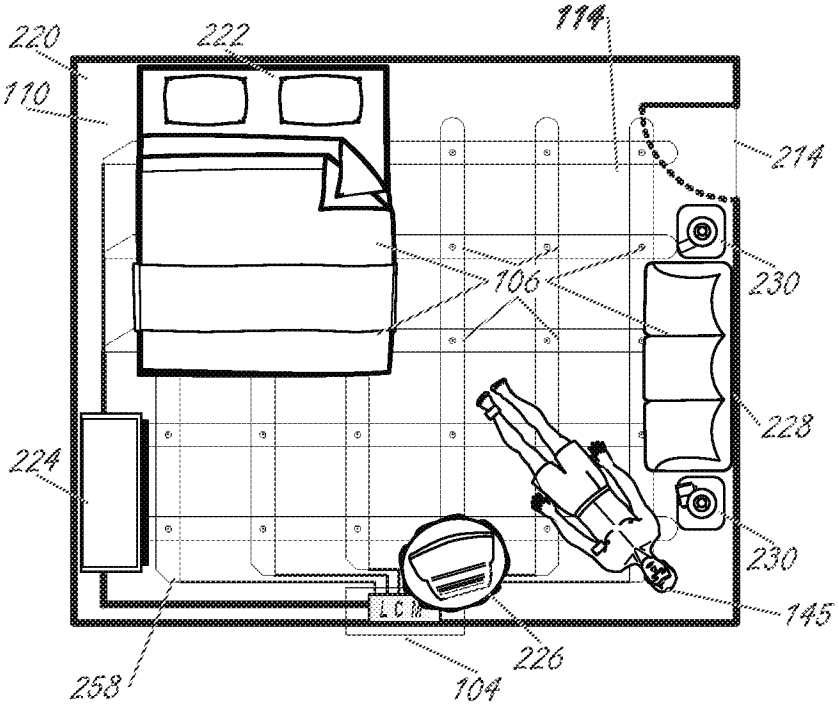

Objects close to the floor, relatively recently occurring, relatively persistent, and of a size consistent with a person 144 may be assessed by the system to be a person close to or on the floor 145. As shown in FIGS. 14A and 14B, these items, reported by the relay module 104 to the central monitoring system 108 are the items for which the PFDS 100 is designed to recognize. When a body worn unit 102 is used in combination with, for example, a data encoder 209 implementing a digital function $f_{ID}$, resident 144 specific processing such as, e.g., size, height, usual locomotion speed, and urgency of notification, may be undertaken.

There may be times when a person wearing the transponder needs to remove the body worn unit 102, but still requires fall detection monitoring by the PFDS system (e.g., a person taking a shower). Sensors can be placed in key locations, like a hook on a wall outside a shower so that when the body worn unit 102 is placed on or near the sensor, the central monitoring system 108 recognizes that the person 144 is in the shower. In some embodiments, a timer is started so that if the body worn unit 102 is not removed before the timer expires, an alert or notification is produced by the central monitoring system 108. The elapsed time, while counting down, may be reset and possibly may be customized by ID, time of day, etc. In some embodiments, a similar sensor could be placed to indicate when a person is sleeping in bed. Alternatively, a plurality of floor elements 106 may be placed in a layer under a mattress if, for example, the person 144 chooses to use a body worn unit 102 while sleeping. The central monitoring system may be programmed to recognize the location of the bed and therefore determine that the person 144 is sleeping or resting.

It is contemplated that some embodiments of the PFDS 100 may detect a fall without the person being monitored by a worn body worn unit 102. For example, the plurality of floor elements 106 may include an array of capacitive or inductive elements or coils. The relay module may include capacitive or inductive change detection circuits. Under non-fall conditions, a first level of capacitive or inductive coupling is achieved between each element of the plurality of floor elements 106. For example, capacitive or inductive change detection circuits identify isolated capacitive or inductive changes, for example, attributable to individuals who are standing or walking. That is, the inductive or capacitive changes are isolated to discrete areas correlated in size to an individual in an upright or even a seated position. However, during a fall condition, a person's body will extend across multiple floor elements, thereby modifying the capacitive or inductive coupling between the floor elements over a substantial area. The increase in coupling above a threshold of an absolute level, or changes following a predetermined duration/level change profile, such as in a sudden change in coupled surface area, will cause the central monitoring system 108 to detect the fall and to issue a fall detection alarm or warning. A reference or baseline capacitive or inductive coupling value is used for the determination of the threshold value. Multiple threshold values or characteristics may be used, for example, to differentiate a fall from standing, walking, sitting, or other non-fall conditions.

Another embodiment that does not require a body worn unit 102 and may use resonant change sensing to perform fall detection. In this embodiment, the plurality of floor elements 106 comprise resonant elements and the relay module 104 includes resonant change (change in Q-factor) detection circuits. Much like the embodiments above, during a fall condition, the person becomes positioned on the floor in close proximity to more than one resonant element, causing a significant and detectable increase in the total electrical Q-factor measured by the relay module. A threshold value, for example, as a change from the measured baseline for the non-fall condition, may be used so that a change from the long-term state of the PFDS 100 causes the central monitoring system 108 to detect a fall. In an alternative embodiment, enhanced resonant change sensing may be employed by having the person wear a body worn unit 102 that comprises ferromagnetic materials that aid in increasing the change in resonance during the fall condition. In this embodiment, the body worn unit 102 may be partially or completely passive and, thus, require little or no electronic circuitry.

In some embodiments, the plurality of floor elements 106 may include membrane switches or force detection strain gauges. Under non-fall conditions, a small number of switches or strain gauges are activated, such as by a person walking or standing. During a fall condition, the number of floor elements activated in a given area increases and, upon sensing this change, a fall is detected by the central monitoring system. The thresholds used for detecting the fall may vary relative to the size and weight of the person being monitored. To this end, a variety of baseline values may be determined to increase the accuracy of the PFDS 100. For example, a smaller person may activate fewer switches or exert lower measurable forces across multiple floor elements. Thus, a lower baseline and threshold value may be required for a smaller person to be adequately monitored. Conversely, the baseline and threshold values may need to be increased or otherwise modified for a large person. Additionally, the central monitoring system 108 would be calibrated so that wheelchair and gurney activities are recognized as classes of non-fall activities (path-based analysis and individualized profiles will assist in reducing false positives).

It is also contemplated that another embodiment includes magnetic sensing or switching elements in the plurality of floor elements 106. The magnetic sensing or switching elements may include Hall-effect sensors, giant magneto-resistance (GMR) sensors, anisotropic magneto-resistance (AMR) sensors, mechanical magnetically closed switches, or the like. The body worn unit 102 may include one or more magnets. In the fall condition, the body worn unit 102 is in close proximity to at least one of the floor elements and the magnetic field of the magnets in the body worn unit 102 is detected, thereby allowing the central monitoring system 108 to detect the fall. An alarm or warning would then be issued by the central monitoring system. Alternatively, the plurality of floor elements 106 may include magnets and the body worn unit includes the magnetic sensing or switching as described above. In a fall condition, the activation of the magnetic sensing in the body worn unit 102 triggers an alternative means of communication with the relay module 104 thereby detecting the fall. The communications may be wireless through radio frequency, ultrasonic, or other communications protocols.

Further embodiments of the PFDS 100 may include the body worn unit 102 that comprises a radio frequency tag that has a unique serial number and a load-modulated return signal. The plurality of floor elements 106 includes reader-coupling elements. During non-fall conditions, there is sufficient separation above the floor such that there is measurably little or no communication or coupling (the link is "open") with the body worn unit 102. In the fall condition, with the subject lying on the floor, the body worn unit 102 becomes sufficiently close to the floor reader elements and communication (the link is "closed") is established, thereby allowing the relayed charge to allow central monitoring system 108 to initiate a fall alert. The body worn unit 102 may also be equipped with a sensor (such as a temperature sensor) to verify that it is being worn.

A further embodiment of the PFDS 100 may include the body worn unit 102 that comprises a commercially available radio frequency identification (RFID) tag and the plurality of floor elements 106 from the previous example, detecting a fall based on a response time delay change. In this embodiment, the body worn unit 102 is monitored by means of the floor elements 106 at all times. During a non-fall condition, the nominal path between the body worn unit 102 and a floor element may be approximately one meter if the body worn unit is worn at the waist of the person being monitored. Thus, the communication path is approximately 2 meters, resulting in a roughly six-nanosecond delay between transmission and reception of the signal (assuming that free space propagation is nominally one ns/foot). The six-nanosecond time delay represents a baseline value. During the fall condition, the body worn unit 102 is in close proximity to a floor element 106, such that the round trip time is shorter and can be detected by the central monitoring system 108 or the relay module 104, said detection triggering the detection of a fall event.

Some embodiments include monitoring a change in amplitude, i.e., amplitude modulation (AM), or changes in frequency, i.e., frequency modulation (FM), to detect a fall condition. Using the body worn unit 102 that comprises a commercially available RFID tag and the plurality of floor elements 106 in constant communication from the previous example, a variety of techniques are employed with AM or FM to detect a fall. In these embodiments a fall condition allows the circuitry in the relay module 104 to detect a change in the amplitude/frequency, a slew rate change (rapidity of amplitude/frequency change) in the amplitude/frequency, or an acceleration change (rate of amplitude/frequency change) in the amplitude/frequency to trigger a fall detection.

Another embodiment of the PFDS 100 includes the body worn unit 102 that comprises a commercially available RFID unit and the plurality of floor elements 106 without constant communication. The body worn unit 102 may employ a custom divide-by-two (or other ratio) when in close proximity to the floor elements in a fall condition. During non-fall conditions, the body worn unit 102 is positioned outside the range of coupling with the floor elements and no signal is sent. In a further embodiment, the body worn unit may include an accelerometer capable of changing the output modulation (for example, based on the vector sum of accelerometer outputs) and/or frequency (such as a divide by 4) as a falling indicator. In another related embodiment, averaged acceleration vectors on a periodic basis can set a status flag (for example, using simple binning) that in turn modulates/modifies the return signals. The binned return signals are analyzed by the central monitoring system 108 to determine if a fall has occurred. It is contemplated that the body worn unit 102 may employ a wake on event/inertia feature of the accelerometer and initiate communications with the central monitoring system 108. Additionally, data from a nominal period before and after a fall event detected by the accelerometer may be recorded and transmitted to the central monitoring system 108.

It is also contemplated that further embodiments may include ultrasonic communication techniques in place of the radio frequency communication disclosed in the previous descriptions of embodiments. The body worn unit 102 may include an ultrasonic transducer and the plurality of floor elements 106 may comprise ultrasonic receiving elements such as transducers or piezoelectric films. Communications can be established during a fall condition when the body worn 102 unit is in close proximity to a floor element. A further embodiment with ultrasonic communications may employ a time delay based on the transmit path distance and require constant communications. Using, as a non-limiting example, a nominal path length of two meters as before the non-fall condition would result in a time delay of about 5.8 milliseconds (assuming acoustic propagation is nominally 343 meters per second). During a fall condition, the time delay is much shorter and the difference is used to detect a fall. In this example, the change in time delay may be as much as 5 milliseconds.

There are event detection schemes that can fall into classes such as a) time-based detections—variations from the base state that follow a speed and direction profile; b) proximity-based detections, including but not limited to the shape (footprint) of the proximity profile; c) polling-based detection; and d) alert-based detection.

There are also structural options such as a) detection without body worn units; b) detection with passive (no-internal-power) units; c) passive individualized units where the passive unit replies (similar to an RFID circuit); d) where the reply is modified by passive sensors (e.g., temperature sensors with hysteresis); and e) active body worn units that wake and respond to probes.

Any of the embodiments described herein may be modified to include any of the structures or methodologies disclosed in connection with different embodiments. Further, the present disclosure is not limited to proximity-based fall detection systems of the type specifically shown.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive rights to all modifications that come within the scope of the appended claims are reserved.

We claim:

1. A fall detection system comprising:

a relay module;

a plurality of sensors comprising a first group of sensors and a second group of sensors, at least one of the plurality of sensors coupled to or disposed near a floor, each of the plurality of sensors configured to transmit an activation signal having a range corresponding to a fall detection range multiple times within a predetermined amount of time and to transmit an interrogation signal having an interrogation range extending to at least twice the fall detection range once within the predetermined amount of time, wherein the first group of sensors are disposed along a first signal line and are electrically coupled to the relay module via the first signal line, and the second group of sensors are disposed along a second signal line and are electrically coupled to the relay module via the second signal line; and a central monitoring system in signal communication with the plurality of sensors, the central monitoring system configured to (i) receive a response signal in response to at least one of the activation signals being transmitted from the plurality of sensors, and (ii) determine whether the response signal is indicative of a person being arranged in a prone position on the floor.

2. The fall detection system of claim 1, further comprising a mobile unit carried by the person.

3. The fall detection system of claim 2, (a) wherein (i) the mobile unit includes a body worn unit including a wearable transponder, the wearable transponder configured to transmit the response signal, and (ii) each of the plurality of sensors includes an antenna; and (b) wherein (i) the wearable transponder does not transmit the response signal to the central monitoring system when the wearable transponder is positioned outside a range of each of the activation signals transmitted by the plurality of sensors, and (ii) the wearable transponder does transmit the response signal to the central monitoring system when the wearable transponder is positioned inside the range of at least one of the activation signals of the plurality of antennas.

4. The fall detection system of claim 3, wherein the response signal includes at least a personal identifier of the person wearing the wearable transponder, and the central monitoring system is configured to determine an identity of the person wearing the wearable responder based upon the personal identifier.

5. The fall detection system of claim 3, wherein the central monitoring system is configured to determine a location on the floor of the person arranged in the prone position based upon at least one of (i) a strength of the response signal transmitted from at least one of the plurality of sensors, and (ii) a known location of at least one of the plurality of sensors transmitting the response signal.

6. The fall detection system of claim 3, wherein the central monitoring system is configured to communicate with the relay module so as to transmit the activation signal for each of the plurality of sensors.

7. The fall detection system of claim 3, wherein the activation signals are transmitted sequentially from the plurality of sensors.

8. The fall detection system of claim 3, wherein at least two of the plurality of sensors transmit activation signals simultaneously, said at least two of the plurality of sensors spaced a distance apart sufficient to prevent interference between the simultaneously active signals.

9. The fall detection system of claim 1, wherein the activation signal is a signal produced by near field communication, and a range of the activation signal is between zero feet to about three feet.

10. The fall detection system of claim 1, wherein the plurality of sensors include at least one of capacitive sensors, inductive sensors, near field communications sensors, resonant change sensors, membrane switches, force detecting strain gauges, magnetic sensors, switching elements, Hall-effect sensors, giant magneto resistance (GMR) sensors, anisotropic magneto resistance (AMR) sensors, mechanical or magnetically closed switches, radio frequency (RF) sensors, proximity sensors, or ultrasonic sensors.

11. The fall detection system of claim 1, wherein the activation signal includes a characteristic of signal intensity, frequency, or frequency variation.

12. A fall detection system comprising:

a wearable transponder;

a plurality of antennas, at least one of the plurality of antennas coupled to or disposed near a floor; and a central monitoring system in signal communication with the plurality of antennas; and wherein (i) each of the plurality of antennas transmits (a) an activation signal having a range corresponding to a fall detection range multiple times within a predetermined amount of time, and (b) an interrogation signal having an interrogation range extending to at least twice the fall detection range once within the predetermined amount of time such that the activation signal is transmitted multiple times for each time that the interrogation signal is transmitted, (ii) the wearable transponder does not transmit a response signal when the wearable transponder is positioned outside the range of the interrogation signals transmitted by the plurality of antennas, (iii) the wearable transponder does transmit the response signal to the central monitoring system when the wearable transponder is positioned inside the interrogation range of any one of the interrogation signals of the plurality of antennas, and (iv) the central monitoring system is configured to receive the response signal, and based upon the response signal, determine at least one of (a) whether the wearable transponder is operating correctly, (b) whether the wearable transponder is being worn, (c) an identity of a person wearing the wearable transponder, or (d) a location of a person wearing the wearable transponder.

13. The fall detection system of claim 12, wherein the response signal includes at least a personal identifier of the person wearing the wearable transponder, and the central monitoring system is configured to determine the identity of the person wearing the wearable transponder based upon the personal identifier.

14. The fall detection system of claim 12, wherein the central monitoring system is configured to determine the location of the person wearing the wearable transponder based upon (i) a strength of the response signal from the at least one antenna of the plurality of antennas transmitting the response signal, and (ii) a location of each antenna of the plurality of antennas.

15. The fall detection system of claim 12, wherein the central monitoring system is configured to determine that the person is wearing the wearable transponder based upon information in the response signal including at least one of body temperature, heart rate, or electrocardiogram readings from the wearable transponder.

16. The fall detection system of claim 15, wherein the central monitoring system is configured to cause the plurality of antennas to transmit the interrogation signal.

17. The fall detection system of claim 12, wherein the interrogation signal is a near field communication signal and the range of the interrogation signal is between zero feet to approximately ten feet.

18. The fall detection system of claim 12, which includes a relay module in electrical communication with each of the plurality of antennas, wherein the central monitoring system is in signal communication with the plurality of antennas via the relay module.

19. A fall detection method comprising:

transmitting a plurality of response signals based upon feedback from a respective plurality of sensors disposed on a floor, wherein each of the plurality of response signals are associated with a single wearable transponder and are responsive to a particular activation signal transmitted by one of the plurality of sensors at a particular time;

transmitting an interrogation signal from the central monitoring system to at least one of the plurality of sensors at a first time;

waiting a predetermined amount of time;

in response to the predetermined amount of time elapsing, transmitting the interrogation from the central monitoring system to one or more sensors of the plurality of sensors at a second time;

transmitting the activation signal from the central monitoring system to at least the plurality of sensors during the predetermined amount of time such that each of the plurality of sensors transmits the activation signal multiple times before the predetermined amount of time elapses;

receiving the plurality of response signals at a central monitoring system; and processing the plurality of response signals at the central monitoring system to determine, based on the plurality of response signals received from the respective plurality of sensors, whether the feedback from the plurality of sensors is indicative of a person having fallen on the floor.

20. The method of claim 19, which includes determining an identity of the person having fallen on the floor using information received from a mobile unit carried by the person, wherein the mobile unit comprises the wearable transponder.

21. The method of claim 19, which includes (i) transmitting the plurality of response signals from the wearable transponder to the central monitoring system through the plurality of sensors when the wearable transponder is positioned inside a range of the particular activation signal of one of the plurality of sensors; and (ii) processing the plurality of response signals at the central monitoring system to generate an output indicative of the person having fallen on the floor.

22. The method of claim 21, which includes identifying a location of the person wearing the wearable transponder based upon the plurality of response signals.

23. The method of claim 21, which includes (i) transmitting a response signal by the wearable transponder to the central monitoring system through at least one of the plurality of sensors when the wearable transponder is positioned inside an extended predetermined range of any one of the interrogation signals of the plurality of sensors; and (ii) generating an output by the central monitoring system indicating that the wearable transponder is operating.

24. The method of claim 21, which includes generating an output at the central monitoring system indicating a current location of the person wearing the wearable transponder based upon (a) a strength of the plurality of response signals from the respective plurality of sensors and (b) a sensor location of each of the plurality of sensors.

25. The method of claim 23, which includes generating an output at the central monitoring system indicating that the person is wearing the wearable transponder based upon information in the response signal, the information including least one of body temperature, heart rate, or electrocardiogram readings from the wearable transponder.

26. The method of claim 23, which includes sequentially transmitting the activation signal from the central monitoring system to at least the plurality of sensors during the predetermined amount of time such that each of the plurality of sensors transmits the activation signal multiple times before the predetermined amount of time elapses.

* * * * *